US008731224B2

(12) United States Patent
Shiozawa et al.

(10) Patent No.: US 8,731,224 B2
(45) Date of Patent: May 20, 2014

(54) ACOUSTIC STRUCTURE INCLUDING HELMHOLTZ RESONATOR

(75) Inventors: Yasuo Shiozawa, Hamamatsu (JP); Hirofumi Onitsuka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 424 days.

(21) Appl. No.: 13/033,986

(22) Filed: Feb. 24, 2011

(65) Prior Publication Data

US 2011/0206228 A1 Aug. 25, 2011

(30) Foreign Application Priority Data

Feb. 25, 2010 (JP) ..... 2010-040964
Jun. 2, 2010 (JP) ..... 2010-126630

(51) Int. Cl.
*H04R 1/20* (2006.01)
*G10K 11/00* (2006.01)

(52) U.S. Cl.
USPC ..... 381/349; 181/186

(58) Field of Classification Search
USPC ..... 381/349; 181/186, 292
See application file for complete search history.

(56) References Cited

U.S. PATENT DOCUMENTS 3,826,333 A 7/1974 Buckwalter
6,021,612 A 2/2000 Dunn et al.
7,103,193 B2 * 9/2006 Croft, III ..... 381/345
8,107,663 B2 * 1/2012 Lin ..... 381/371
2002/0061114 A1 5/2002 Croft, III
2004/0134334 A1 * 7/2004 Baggs ..... 84/723
2006/0219474 A1 10/2006 Goh et al.

FOREIGN PATENT DOCUMENTS

CN 184222 10/2006
JP 58-197994 A 11/1983
JP 61-234195 A 10/1986
JP 04-159898 A 6/1992
JP 07-031564 A 2/1995
JP 2005-086590 A 3/2005

OTHER PUBLICATIONS

Anonymous. (Feb. 1, 1978). "Sound and Acoustic Wave," pp. 114-119, with English Translation, 19 pages.
Anonymous. (May 10, 2005). "Acoustoelectronics: Basics and Applications,", pp. 75-89, with English Translation, 30 pages.
Chinese First Office Action for Application No. 2011-100467551.1, mailed May 16, 2013, 15 pages.
Extended European Search Report mailed Oct. 28, 2013, for EP Application No. 11001507.0, ten pages.
Notice of Grounds for Rejection (Office Action) mailed Dec. 3, 2013, for JP Application No., 2010-126630, with English translation, four pages.

* cited by examiner

*Primary Examiner* — Brian Ensey
(74) *Attorney, Agent, or Firm* — Morrison & Foerster LLP

(57) ABSTRACT

In a bass reflex type speaker, a Helmholtz resonator is formed by a bass reflex port and a space within a speaker enclosure excluding the bass reflex port and a speaker unit. The bass reflex port of the bass reflex type speaker is movable toward and away from a side surface while maintaining its projecting direction within the speaker enclosure. In response to such movement of the bass reflex port, relative positional relationship between a neck and cavity of the bass reflex type speaker varies.

12 Claims, 18 Drawing Sheets

ACOUSTIC STRUCTURE INCLUDING HELMHOLTZ RESONATOR

BACKGROUND

The present invention relates to an acoustic structure including one or two Helmholtz resonators.

Among the conventionally-known acoustic structures including a Helmholtz resonator, such as bass reflex type speakers and resonance type sound absorbing panels, are ones which can set the Helmholtz resonator at a desired resonant frequency. Japanese Patent Application Laid-open Publication No. HEI-04-159898 (hereinafter referred to as "patent literature 1") and Japanese Patent Application Laid-open Publication No. 2005-86590 (hereinafter referred to as "patent literature 2"), for example, disclose a technique for setting a resonant frequency by adjusting a length L of a neck (or neck length L) from among three factors that determine a resonant frequency of a Helmholtz resonator, i.e. an area S of an open surface (open surface area S) of a neck, a volume V of a cavity communicating with the neck, and the neck length L from a boundary surface between the neck and the cavity to the open surface of the neck.

In the bass reflex type speaker disclosed in patent literature 1, a bass reflex port of a cylindrical shape is fixed at its open end to a front wall portion of a speaker enclosure. Within the speaker enclosure, there are provided a cylindrical auxiliary port that surrounds the outer periphery of the bass reflex port, and a drive mechanism for driving the auxiliary port to move along the outer periphery of the bass reflex port. Further, in this bass reflex type speaker, the bass reflex port and the auxiliary port function as the neck of the Helmholtz resonator.

As well known in the art, there exists predetermined relationship among the area S of the open surface of the neck, volume V of the cavity, neck length L and resonant frequency f in a Helmholtz resonator as shown in the following mathematical expression:

$$f=(c/2\pi)[S/\{(L+\Delta L)V\}]^{1/2} \quad (1),$$

where "c" indicates sound speed, and "ΔL" indicates an open end correction value (if the radius of the open surface is indicated by r, then ΔL=0.85r×2).

Thus, it is possible to increase or raise the resonant frequency f of the bass reflex type speaker disclosed in patent literature 1 by moving the auxiliary port toward the front surface (i.e., by decreasing the neck length L) and decrease or lower the resonant frequency f by moving the auxiliary port away from the rear surface (i.e., by increasing the neck length L). Therefore, a user of this bass reflex type speaker can set a lower limit frequency of a sound enhancing frequency band through driving of the auxiliary port.

The sound absorbing device disclosed in patent literature 2 includes top and bottom surface plates opposed to each other via four side surface plates, and an accordion-shaped hose having an open end provided in the top surface plate and extending toward the bottom surface plate. In this sound absorbing device, the accordion-shaped hose functions as the neck of the Helmholtz resonator. The resonant frequency f of the sound absorbing device disclosed in patent literature 2 is increased (or raised) by contraction of the hose and decreased (or lowered) by expansion of the hose. Thus, a user of the sound absorbing device can set a frequency of a sound to be absorbed, through contraction/expansion of the hose.

With the techniques disclosed in patent literatures 1 and 2 above, however, there would be presented the problem that it is almost impossible to vary the resonant frequency unless the cylindrical member functioning as the neck is designed to be capable of being expanded sufficiently.

SUMMARY OF THE INVENTION

In view of the foregoing, it is an object of the present invention to provide an improved technique for allowing a resonant frequency to vary to a desired frequency without changing the neck length, area of the open surface and volume of the cavity of a Helmholtz resonator provided in an acoustic structure.

In order to accomplish the above-mentioned object, the present invention provides an improved acoustic structure provided with a Helmholtz resonator, the acoustic structure being constructed to permit variation in relative positional relationship between a neck of the Helmholtz resonator and a cavity of the Helmholtz resonator communicating with the neck. The acoustic structure of the present invention was invented on the basis of results of research by the inventors etc. that a resonant frequency of the Helmholtz resonator is varied as relative positional relationship between the neck and the cavity even where the length and open surface area of the neck and the volume of the cavity are maintained the same. Thus, the present invention allows the resonant frequency to vary to a frequency without changing the length and open surface area of the neck and the volume of the cavity.

Preferably, the acoustic structure of the present invention includes: two or more layers of panels each having an opening, the two or more layers of panels partitioning between the interior and exterior of the cavity, the neck being formed by an overlapping portion between the openings of the two or more layers of panels; and a sliding member that slides at least one of the two or more layers of panels along the other of the two or more layers of panels.

In another preferred implementation, the acoustic structure of the present invention includes: two or more layers of panels each having an opening, the two or more layers of panels partitioning between the interior and exterior of the cavity, the neck being formed by an overlapping portion between the openings of the two or more layers of panels; and a rotation shaft that rotatably supports at least one of the two or more layers of panels.

According to another aspect of the present invention, there is provided an improved acoustic structure, which comprises a plurality of Helmholtz resonators each having a neck and a cavity communicating with the neck, the plurality of Helmholtz resonators being different from each other in relative positional relationship between the neck and the cavity. The plurality of Helmholtz resonators each have a same area of an open surface of the neck, a same volume of the cavity communicating with the neck and a same length from a boundary surface between the cavity and the neck to the open surface of the neck, and in which the Helmholtz resonators are different from each other in relative positional relationship between the neck and the cavity.

The acoustic structure of the present invention was worked out under the following background. As discussed above, a user of the sound absorbing device disclosed in patent literature 2 can set a frequency of a sound to be absorbed, through contraction/expansion of the hose. The sound absorbing device disclosed in patent literature 2, however, cannot absorb sounds of a plurality of frequencies because resonance occurs at a frequency determined by the neck length (L) of that is a length of the hose having been expanded or contracted and, open surface area (S) of the neck and volume (V) of the cavity. One conceivable way to provide a solution to the inconvenience presented by the technique disclosed in patent literature 2 is to construct a more sophisticated sound absorbing device using a plurality of Helmholtz resonators that differ from each other in shape and size of the neck and cavity. Such a more sophisticated sound absorbing device can absorb sounds of a plurality of frequencies, but the sound absorbing device, as a whole, lacks a feeling of design unity and thus would have a poor outer appearance. For these reasons, there has been a great demand for an acoustic structure, such as a sound absorbing device, which is provided with a plurality of Helmholtz resonators and which permits resonance at a plurality of frequencies without impairing a feeling of overall design unity of the device. The acoustic structure of the present invention, which was invented under such a background, permits resonance at a plurality of frequencies without impairing a feeling of overall design unity of the device.

In the acoustic structure of the present invention, a minimum distance between an extension surface defined by an inner region of the neck being extended into the cavity and an intersecting surface intersecting with one of individual surfaces of the cavity which has the neck connected thereto may be differentiated between the Helmholtz resonators.

Alternatively, in the acoustic structure of the present invention, an area of contact between the extension surface (i.e., imaginary extension surface) defined by the inner region of the neck being extended into the cavity and the intersecting surface intersecting with one of the individual surfaces of the cavity which has the neck connected thereto may be differentiated between the Helmholtz resonators.

According to another aspect of the present invention, there is provided an improved acoustic structure provided with a Helmholtz resonator, the Helmholtz resonator having a neck disposed at a position contacting an intersecting surface which intersects with one of the individual surfaces of the cavity which has the neck connected thereto, or at a position near the intersecting surface.

The acoustic structure of the present invention was worked out under the following background. A resonant frequency f of a Helmholtz resonator is determined by three factors, i.e. an open surface area (S) of a neck, volume (V) of a cavity and length (L) of the neck. As indicated by mathematical expression (1) above, the open surface area (S) has to be reduced, or the cavity volume (V) and the neck length (L) have to be increased, in order to allow the Helmholtz resonator to resonate at a lower frequency. However, among the conventionally-known acoustic structures provided with a Helmholtz resonator, there are ones for which design changes to satisfy such a requirement are difficult to make. Thus, the acoustic structure of the present invention is constructed to permit resonance at a desired frequency without changing the original open surface area (S) of the neck, cavity volume (V) or neck length (L).

In the acoustic structure of the present invention, the Helmholtz resonator may have a plurality of necks communicating with a single cavity, and the plurality of necks may be disposed separately or in spaced-apart relation to each other along the intersecting surface.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

First Embodiment

Figure 1A:
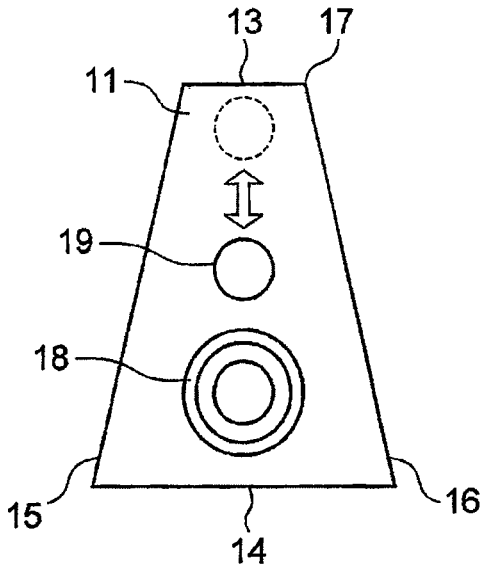
FIGS. 1A and 1B are a front view and a side view, respectively, of a bass reflex type speaker that constitutes a first embodiment of an acoustic structure of the present invention.
Figure 1B:
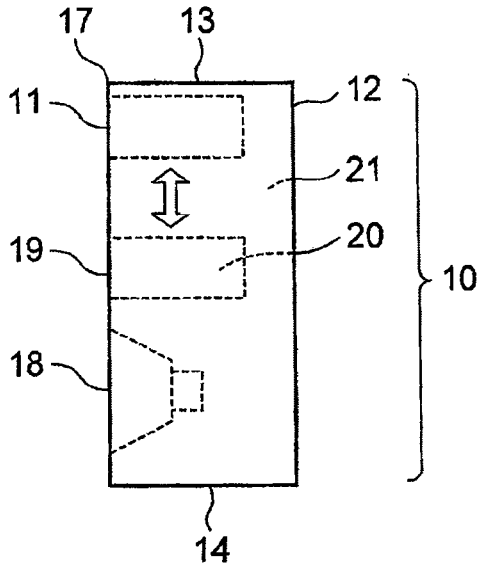

FIGS. 1A and 1B are a front view and a side view, respectively, of a bass reflex type speaker 10 that constitutes a first embodiment of an acoustic structure of the present invention. As illustratively shown in FIGS. 1A and 1B, the bass reflex type speaker 10 includes a speaker unit 18 provided on a front surface 11 of a speaker enclosure 17 having the front surface 11, rear surface 12 and four side surfaces 13, 14, 15 and 16. The bass reflex type speaker 10 also includes a bass reflex port 20 of a cylindrical shape that has an open surface 19 located in the front surface 11 and that projects into the speaker enclosure 17. In this bass reflex type speaker 10, a Helmholtz resonator is formed by the bass reflex port 20 and a space 21 within the speaker enclosure 17 excluding the bass reflex port 20 and speaker unit 18. In bass reflex type speaker 10, the bass reflex port 20 and the space 21 function as the neck and cavity, respectively, of the Helmholtz resonator. Thus, as the speaker unit 18 audibly generates a sound of a frequency band equal to or higher than a resonant frequency f, a sound of a same phase as that sound is audibly generated from the open surface 19, so that the sound of the frequency band equal to or higher than the resonant frequency f can be enhanced.

The bass reflex type speaker 10 is constructed to permit variation in relative positional relationship between the bass reflex port 20 performing the function of the neck in the speaker 10 and the space 21 performing the function of the cavity in the speaker 10. More specifically, as illustratively shown in FIGS. 1A and 1B, the bass reflex port 20 of the bass reflex type speaker 10 is movable or translatable toward and away from the side surface 13 (i.e., in a direction indicated by a white double-head arrow shown in FIG. 1) while maintaining its projecting direction within the speaker enclosure 17.

Figure 2:
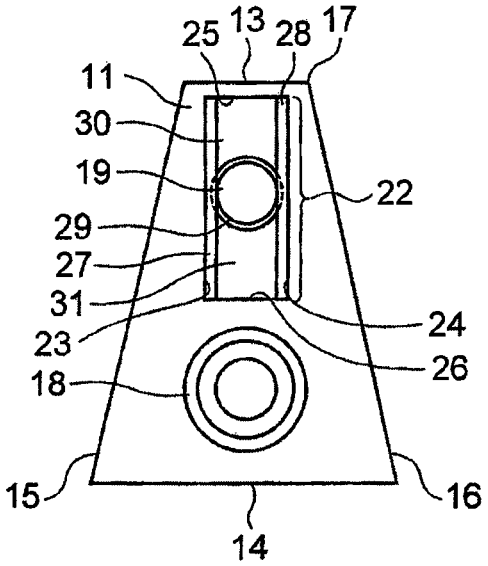
FIG. 2 is a view showing an example construction for realizing movement of a bass reflex port in the bass reflex type speaker of FIG. 1.

Arrangements for translating the bass reflex port 20 as above may be made, for example, in one of the following two ways. According to the first way, as illustratively shown in FIG. 2, a portion of the front surface 11 immediately above the speaker unit 18 is cut out in a rectangular shape to secure a moving area 22 for the bass reflex port 20, rails 27 and 28 are provided on and along inner sides of opposed side edges 23 and 24 of the moving area 22, and a flange 29 is provided on the outer periphery of the open surface 19 and partly fitted into the rails 27 and 28. Further, elastic materials 30 and 31 are attached between another pair of opposed upper and lower edges 25 and 26 of the moving area 22 and the open surface 19 of the bass reflex port 20 for closing up gaps between the edges 25 and 26 and the open surface 19. In this first way, it is possible to translate or move the bass reflex port 20 while maintaining the same volume V of the space 21.

Figure 3A:
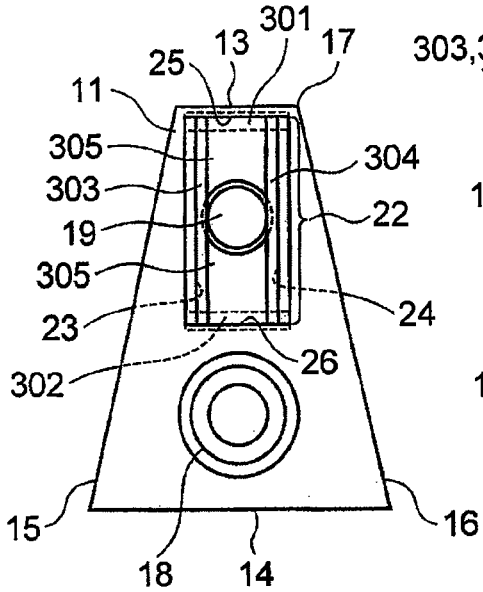
FIGS. 3A-3D are views showing another example construction for realizing movement of the bass reflex port in the bass reflex type speaker of FIG. 1.
Figure 3B:
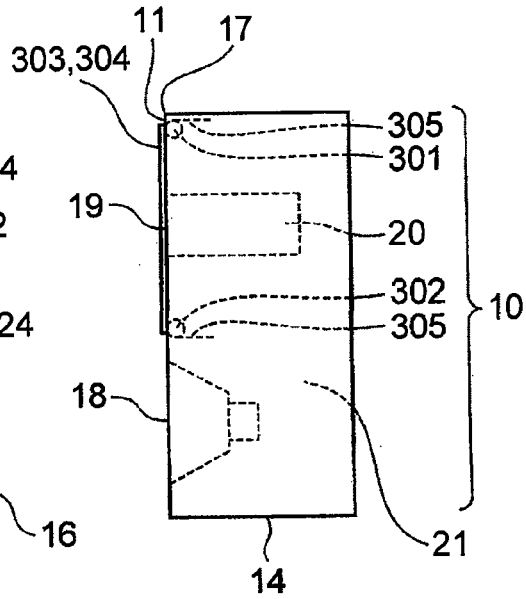
Figure 3C:
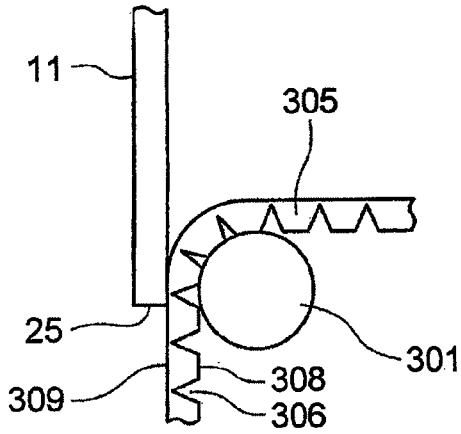
Figure 3D:
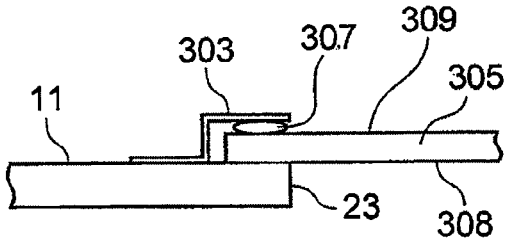

According to the second way, as illustratively shown in FIGS. 3A, 3B, 3C and 3D, rollers 301 and 302 extending parallel to the edges 25 and 26 are provided on inner sides of the edges 25 and 26 in the space 21, and holding frames 303 and 304 are provided on outer sides of the side edges 23 and 24 to extend along the side edges 23 and 24. Further, a flexible member 305 is held by and between the edges 23 and 24, 25 and 26, rollers 301 and 302, and holding frames 303 and 304. More specifically, the flexible member 305 is a plate-shaped member having a dimension slightly greater than a distance between the edges 23 and 24 and a dimension sufficiently greater than a distance between the edges 25 and 26. The flexible member 305 is formed of a material having a sufficient rigidity. As illustratively shown in FIG. 3C, the flexible member 305 has a plurality of parallel horizontal notches 306 formed in its inner surface 308 facing the space 21. The flexible member 305 has its left and right side edge portions received or inserted between the edge 23 and the holding frame 303 and between the edge 24 and the holding frame 304. As illustratively shown in FIG. 3D, each of gaps formed or defined between the left and right side edge portions of the flexible member 305 and the holding frames 303 and 304 is closed with a leaf spring 307 that is disposed between the left or right side edge portion of the flexible member 305 and the holding frame 303 or 304. The left and right side edge portions of the flexible member 305 are normally pressed against the edges 23 and 24 by the biasing force of the left springs 307. Furthermore, upper and lower end portions of the flexible member 305 are inserted between the edge 25 and the roller 301 and between the edge 26 and the roller 302. Furthermore, as shown in FIGS. 3A and 3B, the bass reflex port 20 is fixedly joined to a substantially middle portion of the inner surface 308, facing the space 21, of the flexible member 305, and the open surface 19 of the bass reflex port 20 is exposed out of an outer surface 309 of the flexible member 305. In this second way too, the bass reflex port 20 is allowed to move or translate while maintaining the same volume V of the space 21.

As noted above, the embodiment of the bass reflex type speaker 10 is constructed to permit variation in relative positional relationship between the bass reflex port 20 performing the function of the neck in the speaker 10 and the space 21 performing the function of the cavity in the speaker 10. Thus, the embodiment of the bass reflex type speaker 10 can vary the resonant frequency f to a desired frequency without employing a construction that would change the neck length L, area S of the open surface of the neck and volume V of the cavity. The inventors of the present invention conducted the following three tests in order to confirm or verify advantageous benefits of the embodiment of the bass reflex type speaker 10.

In the first verifying test, the inventors of the present invention determined frequency response of the Helmholtz resonator by variously changing a position P of the neck of the Helmholtz resonator while maintaining the same shape $C_{CAV}$ and volume V of the cavity and the same shape $C_{NEC}$, open surface area S and length L of the neck. More specifically, there were provided Helmholtz resonators a1, a2, a3 and a4 (see FIGS. 4, 5, 6 and 7), respectively, with the shape $C_{CAV}$ and volume V of the cavity and the open surface area S, length L and position P of the neck set as shown in Table 1 below. Then, a sound source was set at a position one meter ahead of each of the Helmholtz resonators a1, a2, a3 and a4, and an observation point was set at a gravity center position within the neck of each of the Helmholtz resonators a1, a2, a3 and a4. After that, for each of the Helmholtz resonators a1, a2, a3 and a4, frequency response was calculated by simulation on a sound generated by the sound source and measured at the observation point. Graph curves a1, a2, a3 and a4 in FIG. 8 indicate the calculated frequency response of the Helmholtz resonators a1, a2, a3 and a4.

TABLE 1

| Shape $C_{CAV}$ of Cavity | Volume V ($mm^3$) | Shape $C_{NEC}$ of Neck | Open Surface Area S ($mm^2$) | Neck Length (mm) | Position P of Neck | Graph Curve |
|---|---|---|---|---|---|---|
| cylindrical shape with square base | 10,000 × 200 | cylindrical shape | 18 × 18 × π | 5 | gravity center of the base | a1 |
| cylindrical shape with square base | 10,000 × 200 | cylindrical shape | 18 × 18 × π | 5 | midpoint between gravity center and one of four corners of the base | a2 |
| cylindrical shape with square base | 10,000 × 200 | cylindrical shape | 18 × 18 × π | 5 | near inside of midpoint of one of four sides of the base | a3 |
| cylindrical shape with square base | 10,000 × 200 | cylindrical shape | 18 × 18 × π | 5 | near inside of midpoint of one of four corners of the base | a4 |

Figure 9:
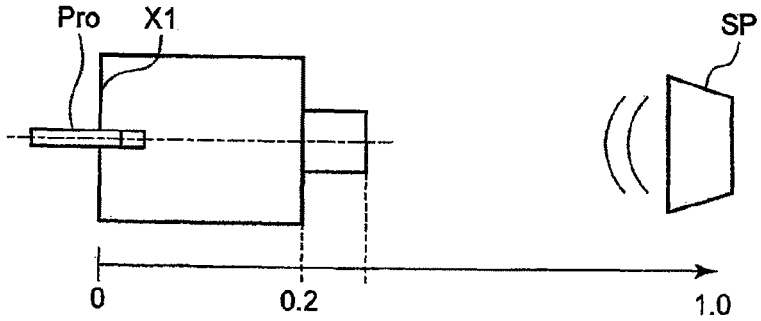
FIG. 9 is a view showing how to measure sound pressure distribution and particle velocity distribution within respective cavities of the Helmholtz resonators shown in FIGS. 4, 5 and 7.
Figure 10:
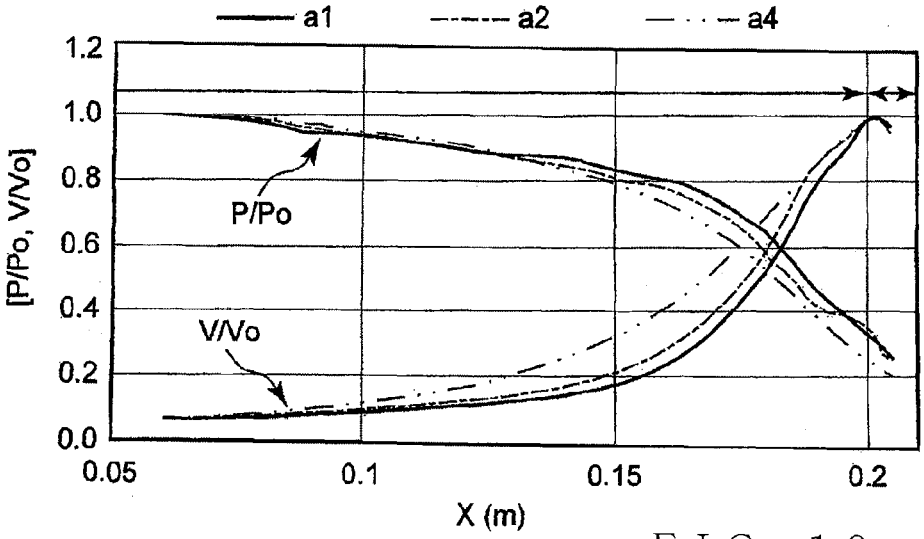
FIG. 10 is a graph showing sound pressure distribution and particle velocity distribution within the respective cavities of the Helmholtz resonators shown in FIGS. 4, 5 and 7.

In the second verifying test, the inventors of the present invention determined sound pressure distribution and particle velocity distribution during resonance of the Helmholtz resonators a1, a2, a3 and a4. More specifically, the inventors of the present invention made resonators of acryl resin having the same sizes as the Helmholtz resonators a1, a2 and a4, as shown in FIG. 9; FIG. 9 shows an example where the Helmholtz resonator a1 is used. Then, the inventors measured, via a sound pressure/particle velocity probe Pro, sound pressure P and particle velocity V at each measurement point located a distance x from a reference surface X1 toward the cavity, by placing a speaker SP at a position located 1.0 m from the reference surface X1 toward the neck and irradiating random noise. Here, the reference surface X1 is a surface of the cavity of each of the three types of resonators opposite from the neck. Then, the inventors of the present invention determined a ratio P/Po by dividing the sound pressure Po, measured at each measurement point located at a distance x>0, by the sound pressure Po measured at a measurement point located at a distance x=0 in each of the Helmholtz resonators a1, a2 and a4, and a ratio V/Vo by dividing the particle velocity V, measured at each measurement point located at the distance x=0, by the particle velocity V measured at each measurement point located at the distance x>0. A graph of FIG. 10 shows relationship between the distance x from the reference surface X1 in each of the Helmholtz resonators a1, a2 and a4 and ratio P/Po and ratio V/Vo.

In the third verifying test, the inventors of the present invention determined frequency response by variously changing the shape $C_{CAV}$ of the cavity and position P of the neck of Helmholtz resonators while maintaining the same volume V of the cavity and the same shape $C_{NEC}$, open surface area S and length L of the neck. More specifically, there were provided Helmholtz resonators b1, b2, b3, b4, b5, b6, b7 and b8 (see FIGS. 11, 12, 13, 14, 15, 16, 17 and 18, respectively) with the shape $C_{CAV}$ and volume V of the cavity and the open surface area S, length L and position P of the neck set respectively as shown in Table 2 below. Then, a sound source was set at a position one meter ahead of each of the Helmholtz resonators b1, b2, b3, b4, b5, b6, b7 and b8, and an observation point was set at the gravity center position within the neck of each of the Helmholtz resonators b1, b2, b3, b4, b5, b6, b7 and b8. After that, for each of the Helmholtz resonators b1, b2, b3, b4, b5, b6, b7 and b8, frequency response was calculated by simulation on a sound generated by the sound source and measured at the observation point. Graph curves b1, b2, b3, b4, b5, b6, b7 and b8 in FIG. 19 indicate the calculated frequency response.

TABLE 2

| Shape $C_{CAV}$ of Cavity | Volume V ($mm^3$) | Shape $C_{NEC}$ of Neck | Open Surface Area S ($mm^2$) | Neck Length (mm) | Position P of Neck | Graph Curve |
|---|---|---|---|---|---|---|
| cylindrical shape | 10,000 × 200 | cylindrical shape | 18 × 18 × π | 5 | near inside of outer periphery of base | b1 |
| cylindrical shape with elliptical base | 10,000 × 200 | cylindrical shape | 18 × 18 × π | 5 | near inside of one of two ends of the base opposed to each other in longitudinal direction of the base | b2 |
| cylindrical shape with base in the form of a surface made by interconnecting a pair of | 10,000 × 200 | cylindrical shape | 18 × 18 × π | 5 | position overlapping the small-diameter perfect circle of | b3 |

TABLE 2-continued

| Shape $C_{CAV}$ of Cavity | Volume V ($mm^3$) | Shape $C_{NEC}$ of Neck | Open Surface Area S ($mm^2$) | Neck Length (mm) | Position P of Neck | Graph Curve |
|---|---|---|---|---|---|---|
| large-and small-diameter perfect circles such that parts of outer peripheries of the circles contact each other | | | | | the base | |
| cylindrical shape with square base | 10,000 × 200 | cylindrical shape | 18 × 18 × π | 5 | near inside of one of the four corners of the base | b4 |
| cylindrical shape with substantially square base having four corners each formed in quarter round | 10,000 × 200 | cylindrical shape | 18 × 18 × π | 5 | near inside of one of the four corners of the base | b5 |
| cylindrical shape with isosceles trapezoidal base | 10,000 × 200 | cylindrical shape | 18 × 18 × π | 5 | near inside of upper base of the trapezoidal base | b6 |
| cylindrical shape with base in the form of a surface made by superimposing square and perfect circle upon each other such that one apex of the square and center of the perfect circle coincide with each other | 10,000 × 200 | cylindrical shape | 18 × 18 × π | 5 | position overlapping the perfect circle of the base | b7 |
| cylindrical shape with rectangular base | 10,000 × 200 | cylindrical shape | 18 × 18 × π | 5 | Near inside of one of two sides opposed to each other in length direction of the base | b8 |

As shown in FIGS. 4 to 7 and 11 to 18, the Helmholtz resonators a1 to a4 and b11 to b8 each comprises the neck connected to one base (undersurface) of the cavity of a cylindrical shape. Relative positional relationship between the cavity and the neck differs from one Helmholtz resonator to another. From results of the first to third verifying tests, it can be seen that the following relationship exists between the relative positional relationship between the cavity and the neck and the resonant frequency f in the Helmholtz resonator.

Figure 4:
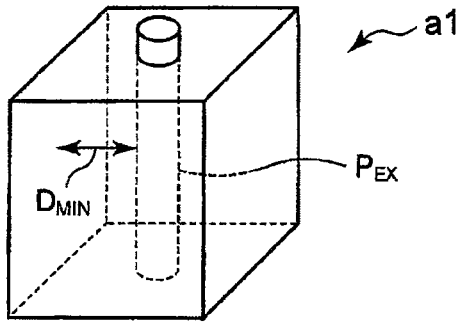
FIG. 4 is a view showing a Helmholtz resonator used for verifying advantageous benefits of the bass reflex type speaker of FIG. 1.
Figure 5:
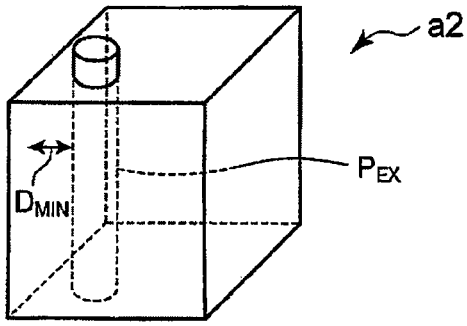
FIG. 5 is a view showing another Helmholtz resonator used for verifying advantageous benefits of the bass reflex type speaker of FIG. 1.
Figure 6:
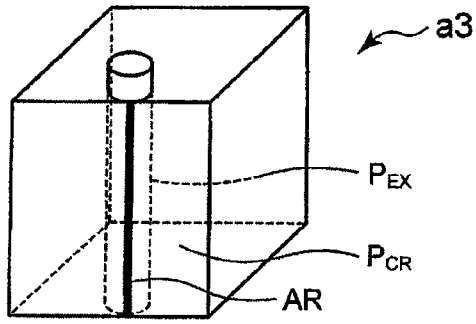
FIG. 6 is a view showing still another Helmholtz resonator used for verifying the advantageous benefits of the bass reflex type speaker of FIG. 1.
Figure 7:
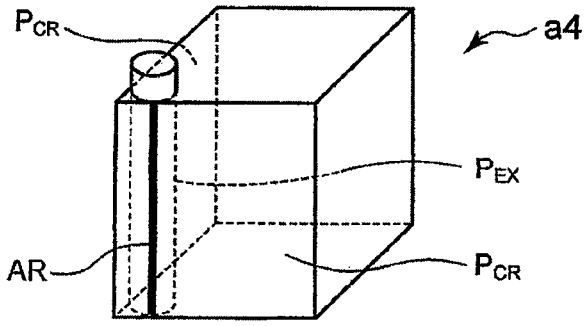
FIG. 7 is a view showing still another Helmholtz resonator used for verifying the advantageous benefits of the bass reflex type speaker of FIG. 1.
Figure 8:
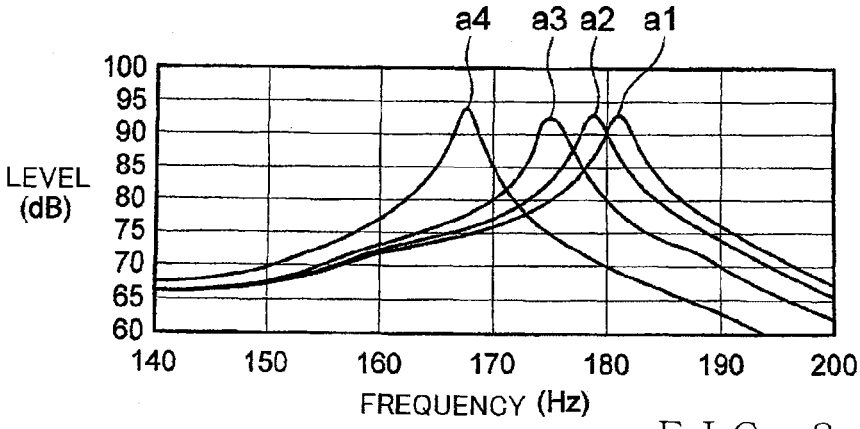
FIG. 8 is a graph showing respective frequency response of the Helmholtz resonators shown in FIGS. 4 to 7.

(1) As shown in FIGS. 4, 5 and 7, large-small relationship in minimum distance DMIN between an imaginary surface defined by an inner region of the neck being extended toward the cavity (hereinafter referred to as "imaginary extension surface PEX") and a surface intersecting with a surface of the cavity to which the neck is connected (i.e., which has the neck connected thereto) (hereinafter referred to as "intersecting surface PCR") among the Helmholtz resonators a1, a2 and a4 is Helmholtz resonator a1>Helmholtz resonator a2>Helmholtz resonator a4. Further, high-low relationship in peak frequency of frequency response among the Helmholtz resonators a1, a2 and a4 shown in FIG. 8 is Helmholtz resonator a1 (182 Hz)>Helmholtz resonator a2 (178 Hz)>Helmholtz resonator a4 (167 Hz). From the foregoing, it can been seen that, if the imaginary extension surface PEX and the intersecting surface PCR are not in contact with each other (i.e., if minimum distance DMIN>0), the resonant frequency f decreases or lowers as the minimum distance DMIN between the imaginary extension surface PEX and the intersecting surface PCR decreases.

(2) As shown in FIGS. 4 to 7, the minimum distance DMIN between the imaginary extension surface PEX and the intersecting surface PCR is greater than 0 (zero) in the Helmholtz resonators a1 and a2, while the minimum distance DMIN is 0 in the Helmholtz resonators a3 and a4. Namely, the imaginary extension surface PEX and the intersecting surface PCR are spaced from each other in the Helmholtz resonators a1 and a2, while the imaginary extension surface PEX and the intersecting surface PCR are in contact with each other in the Helmholtz resonators a3 and a4. Further, an area of contact between the imaginary extension surface PEX and the intersecting surface PCR in the Helmholtz resonator a4 is greater than that in the Helmholtz resonator a3. By contrast, the peak of frequency response (167 Hz) in the Helmholtz resonator a4 is lower than that (175 Hz) in the Helmholtz resonator a3.

Further, looking at the particle velocity V near the neck (i.e., near a position where the distance x from the reference surface x1 is 0.2) in the Helmholtz resonators a1, a2 and a4 of FIG. 10, large-small relationship, among the Helmholtz resonators a1, a2 and a4, in size of a region where the particle velocity V near the neck is equal to or greater than a predetermined value is Helmholtz resonator a4>Helmholtz resonator a2>Helmholtz resonator a1.

Further, in each of the Helmholtz resonators b1 to b8, as shown in FIGS. 11 to 18, the imaginary extension surface PEX and the intersecting surface PCR are in contact with each other (i.e., minimum distance DMIN=0). Large-small relationship in area of contact AR between the imaginary extension surface PEX and the intersecting surface PCR among the Helmholtz resonators b1 to b8 is Helmholtz resonator b8>Helmholtz resonator b3>Helmholtz resonator b2>Helmholtz resonator b6>Helmholtz resonator b5>Helmholtz resonator b4>Helmholtz resonator b7>Helmholtz resonator b1. By contrast, high-low relationship in peak of frequency response among the Helmholtz resonators b1 to b8 sown in FIG. 19 is Helmholtz resonator b8 (143 Hz)<Helmholtz resonator b3 (149 Hz)<Helmholtz resonator b2 (151 Hz)<Helmholtz resonator b6 (153 Hz)<Helmholtz resonator b5 (157 Hz)<Helmholtz resonator b4 (167 Hz)<Helmholtz resonator b7 (168 Hz)<Helmholtz resonator b1 (172 Hz).

From the foregoing, it can be seen that, in the case where the imaginary extension surface PEX and the intersecting surface PCR are in contact with each other (minimum distance DMIN=0), the resonant frequency f lowers as the area of contact AR between the virtual extension surface PER and the intersecting surface PCR increases.

Figure 19:
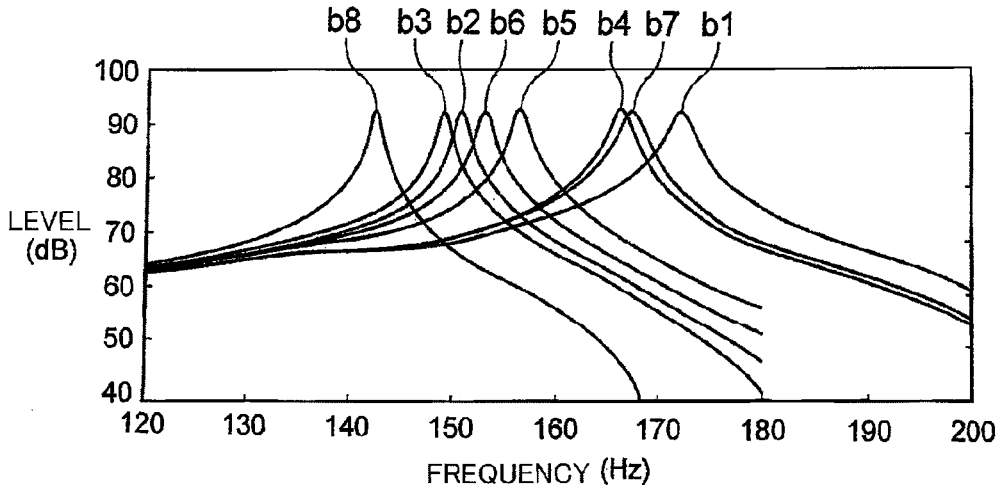
FIG. 19 is a graph showing respective frequency response of the Helmholtz resonators shown in FIGS. 11 to 18.
Figure 20:
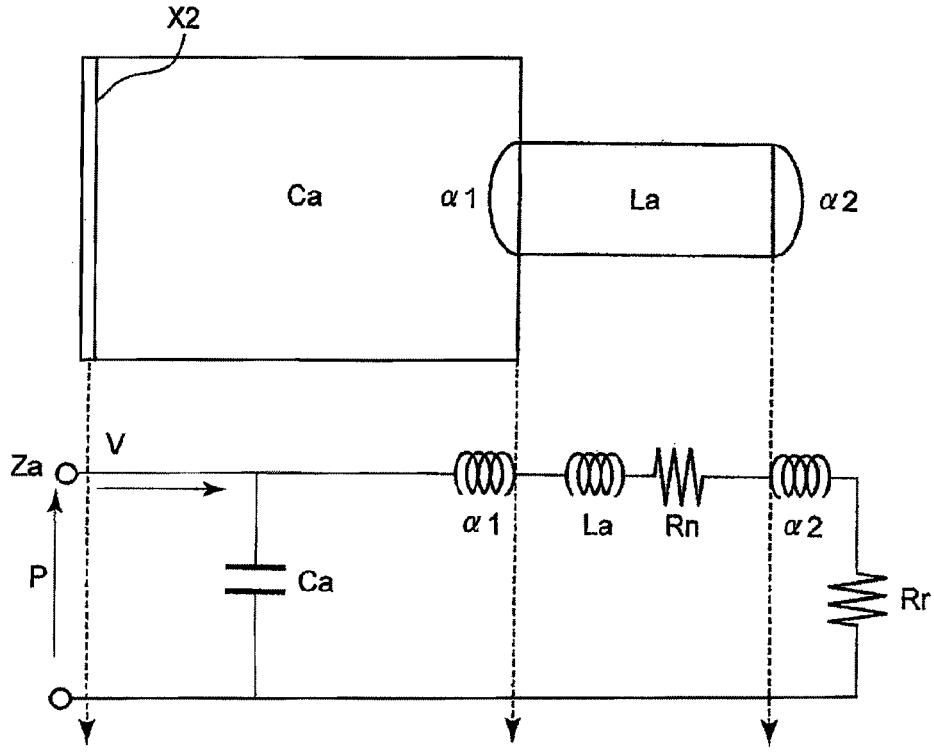
FIG. 20 is a diagram showing a circuit simulating a Helmholtz resonator.

The inventors of the present invention performed the following calculations in order to confirm, from another perspective, relationship among the minimum distance MNIN, area of contact AR and resonant frequency f that can be seen from FIGS. 8, 10 and 19. In the field of acoustics, it is known to calculate audio impedance Za of a closed space surrounded by a wall as impedance of a circuit simulating such a closed space (for details, see "Onkyo Electronics—Kiso to Ouyou" (Acoustic Electronics—Basis and Application), pp 75-89, by Oga Toshiro, Kamakura Tomoo, Saito Shigemi and Takeda Kazuya, published by Baifuukan, May 10, 2004 (hereinafter referred to as non-patent literature 1), and "Oto to Onmpa" (Sound and Sound Wave), pp 114-119, by Kobashi Yutaka, published by Syoukabo, Jan. 25, 1975 (hereinafter referred to as non-patent literature 2). If sound pressure on the base (undersurface) X2 of the cavity opposite from the neck of the Helmholtz resonator is indicated by P, the particle velocity is indicated by V, a parameter representing softness of air within the cavity (i.e., acoustic compliance parameter) is indicated by Ca, a parameter representing a mass of air within the cavity (acoustic mass) is indicated by La, parameters representing masses of air on opposite sides of the neck resonating with the acoustic mass (additional acoustic masses) are indicated by α1 and α2, a parameter representing acoustic resistance within the neck is indicated by Rr and a parameter representing radiation resistance is indicated by Rn, this Helmholtz resonator can be regarded as a circuit having capacity Ca, coil α1, coil La, resistance Rn, coil α2 and resistance Rr connected in parallel to a power supply P, as shown in FIG. 20.

In this circuit, the capacity Ca can be regarded as being in an open state in a region where vibrating frequencies of the base X2 are sufficiently low. Thus, the acoustic impedance Za of the Helmholtz resonator can be approximated by mathematical expression (2) below.

$$Za=Rn+Rr+j2\pi f(\alpha 1+La+\alpha 2) \quad (2)$$

The acoustic impedance Za in mathematical expression (2) above is equal to a value calculated by dividing the sound pressure P by volume velocity Q that is a product between the particle velocity V on the base X2 and the area S of the area of the base X2. Thus, mathematical expression (2) above can be expressed as $$P/Q=Rn+Rr+j2\pi f(\alpha 1+La+\alpha 2) \quad (3)$$

Looking at only on the imaginary part of mathematical expression (3), it can be simplified into mathematical expression (4) below.

$$Im(P/Q)=j2\pi f(\alpha 1+La+\alpha 2) \quad (4)$$

The parameter La in mathematical expression (4) is a value determined by the volume and air density within the neck. The additional acoustic mass "α1+α2" can be determined as follows on the basis of actual measured values of the particle velocity V and sound pressure P on the base X2. First, the volume velocity Q (complex number with a phase taken into account) is determined by multiplying the actual measured value of the particle velocity V on the base X2 by the area S of the base X2, and then, the imaginary part Im (P/Q) of a value calculated by dividing the actual measured value of the sound pressure P (complex number with a phase taken into account) by the volume velocity Q is obtained. After that, "α1+La+α2" in mathematical expression (4) above is calculated by dividing the imaginary part Im (P/Q) by 2πf. Then, the value La determined by the volume and air density within the neck is subtracted from "α1+La+α2", to determine the additional acoustic mass α1+α2.

In light of the foregoing, the inventors of the present invention provided Helmholtz resonators a1-1, a1-2, . . . , a1-N by moving little by little the neck of the Helmholtz resonator a1 of FIG. 4 from the gravity-center position of the surface, having the neck connected thereto, toward one of the four corners (e.g., position of the neck of the Helmholtz resonator a4 shown in FIG. 7), and then individually measured sound pressure P and particle velocity V on the base X2 (i.e., surface opposite from the neck within the cavity) of each of the Helmholtz resonators a1-1, a1-2, . . . , a1-N with the frequency of a sound source sufficiently lowered. Then, a sum between the additional acoustic masses α1 and α2 is calculated for each of the Helmholtz resonators a1-1, a1-2, . . . , a1-N on the basis of the measurements of the sound pressure P and particle velocity V and mathematical expression (4) above. Similarly, the inventors of the present invention provided a Helmholtz resonator b1-0 by locating the neck of the Helmholtz resonator b1 of FIG. 11 at the gravity center position of the surface having the neck connected thereto, and also provided Helmholtz resonators b1-1, b1-2, . . . , b1-M by moving little by little the neck from the center position of the surface, having the neck connected thereto, toward the inner periphery of that surface. Then, sound pressure P and particle velocity V on the base X2 (surface opposite from the neck within the cavity) are individually measured for each of the Helmholtz resonators b1-1, b1-2, . . . , b1-M with the frequency of a sound source sufficiently lowered. After that, a sum between the additional acoustic masses α1 and α2 is calculated for each of the Helmholtz resonators b1-0, b1-1, b1-2, . . . , b1-M on the basis of these measurements of the sound pressure P and particle velocity V and mathematical expression (4) above.

Figure 21:
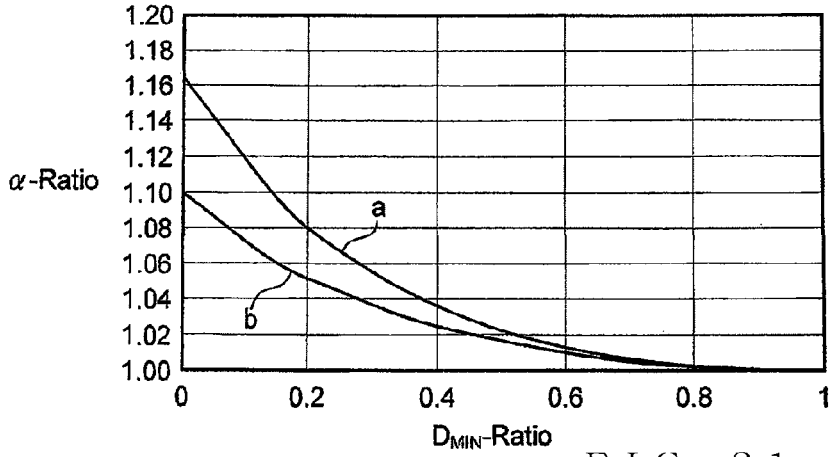
FIG. 21 is a graph showing relationship between a minimum distance between a virtual extension surface and an intersecting surface and an additional mass of a Helmholtz resonator.

The graph curve a shown in FIG. 21 indicates correspondency relationship between a ratio DMIN-Ratio calculated by dividing the minimum distance DMIN of each of the Helmholtz resonators a1-1, a1-2 . . . , a1-N by the minimum distance DMIN of the Helmholtz resonator a1 (0≤DMIN-Ratio≤1) and a ratio α-Ratio calculated by dividing the additional acoustic amount α1+α2 of each of the Helmholtz resonators a1-1, a1-2, . . . , a1-N by the additional acoustic amount α1+α2 of the Helmholtz resonator a1-0. Further, the graph curve b shown in FIG. 21 indicates correspondency relationship between a ratio DMIN-Ratio calculated by dividing the minimum distance DMIN of each of the Helmholtz resonators b1-1, b1-2, . . . , b1-N by the minimum distance DMIN of the Helmholtz resonator b1 (0≤DMIN-Ratio≤1) and a ratio α-Ratio calculated by dividing the additional acoustic amount α1+α2 of each of the Helmholtz resonators b1-1, b1-2, . . . , b1-N by the additional acoustic amount α1+α2 of the Helmholtz resonator b1-0.

Figure 11:
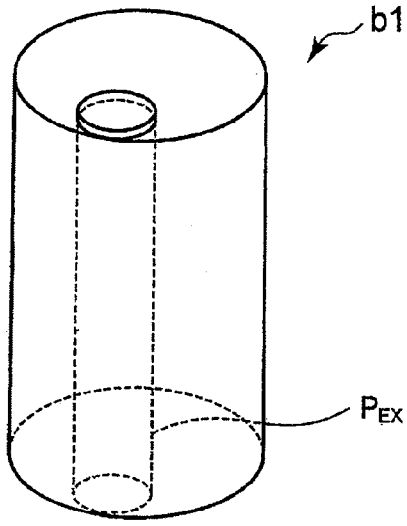
FIG. 11 is a view showing still another Helmholtz resonator used for verifying the advantageous benefits of the bass reflex type speaker of FIG. 1.
Figure 12:
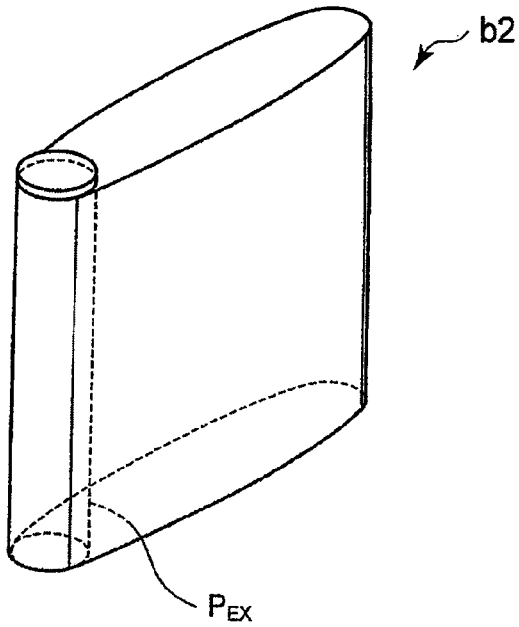
FIG. 12 is a view showing still another Helmholtz resonator used for verifying the advantageous benefits of the bass reflex type speaker of FIG. 1.
Figure 13:
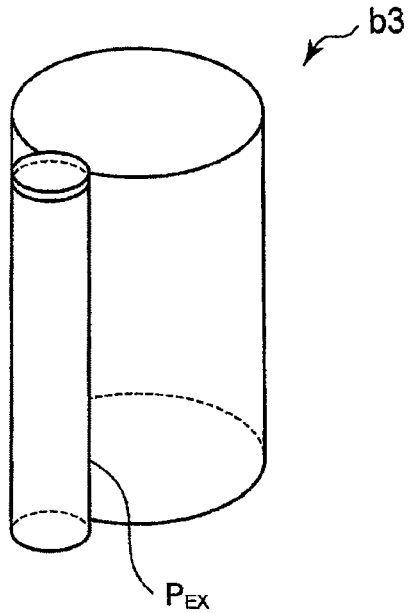
FIG. 13 is a view showing still another Helmholtz resonator used for verifying the advantageous benefits of the bass reflex type speaker of FIG. 1.
Figure 14:
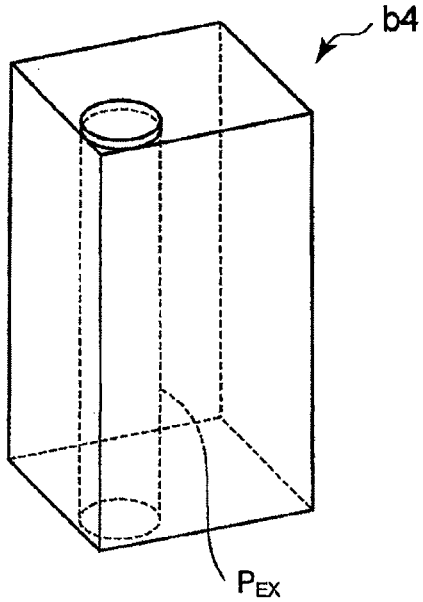
FIG. 14 is a view showing still another Helmholtz resonator used for verifying the advantageous benefits of the bass reflex type speaker of FIG. 1.
Figure 15:
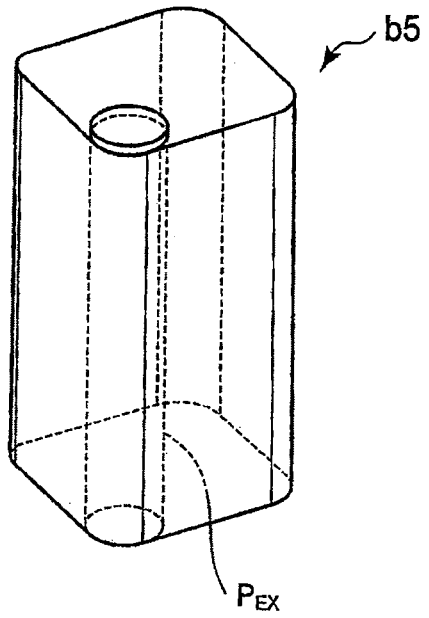
FIG. 15 is a view showing still another Helmholtz resonator used for verifying the advantageous benefits of the bass reflex type speaker of FIG. 1.
Figure 16:
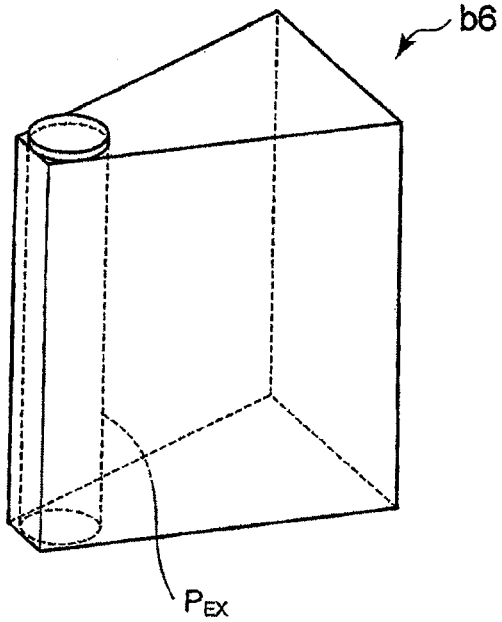
FIG. 16 is a view showing still another Helmholtz resonator used for verifying the advantageous benefits of the bass reflex type speaker of FIG. 1.
Figure 17:
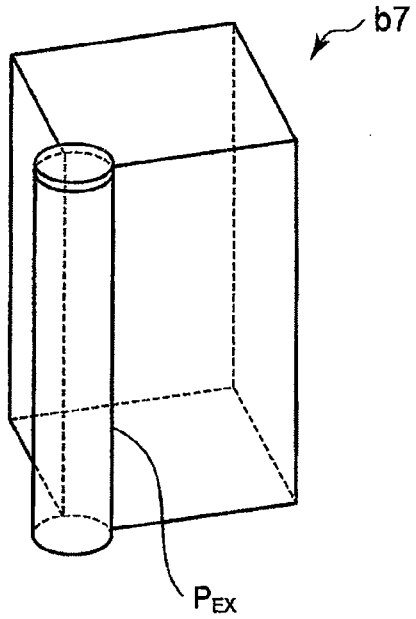
FIG. 17 is a view showing still another Helmholtz resonator used for verifying the advantageous benefits of the bass reflex type speaker of FIG. 1.
Figure 18:
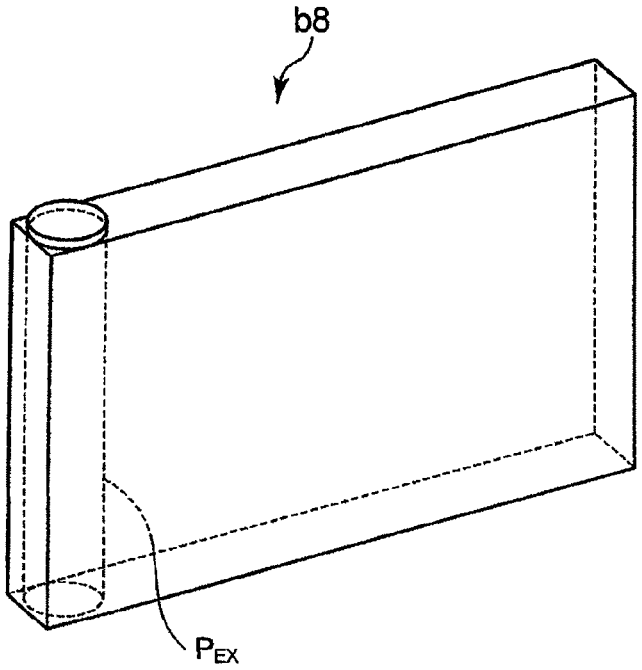
FIG. 18 is a view showing still another Helmholtz resonator used for verifying the advantageous benefits of the bass reflex type speaker of FIG. 1.

As indicated by the graph curve a of FIG. 21, the additional acoustic amount α1+α2 of the Helmholtz resonator a1 increases as the minimum distance DMIN decreases. Further, as indicated by the graph curve b of FIG. 21, the additional acoustic amount α1+α2 of the Helmholtz resonator b1 increases as the minimum distance DMIN decreases. From these too, it can been seen that the resonant frequency f lowers as the minimum distance DMIN between the imaginary extension surface PEX and intersecting surface PCR of the Helmholtz resonator decreases. Comparing the graph curve a and the graph curve b, an increase amount of the additional acoustic amount α1+α2 when the neck has been moved from the center toward the wall surface is greater in the graph curve a than in the graph curve b. The Helmholtz resonator a1 and the Helmholtz resonator b1 are the same in the volume V of the cavity and open surface area S and length L of the neck (Table 1 and Table 2) but different from each other only in the shape of the cavity (FIGS. 4 and 11). From these relationship, it can be seen that the resonant frequency f of each of the Helmholtz resonators depends on the shape of the cavity itself.

Second Embodiment

Figure 22A:
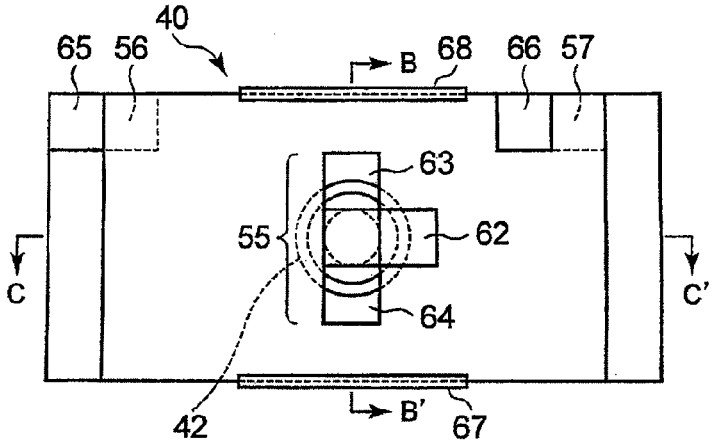
FIG. 22A is a front view of a speaker that constitutes a second embodiment of the acoustic structure of the present invention.
Figure 22B:
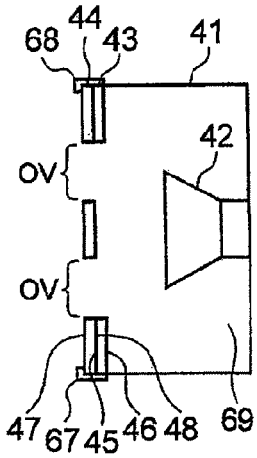
FIG. 22B is a sectional view of the speaker taken along the B-B' line of FIG. 22A.
Figure 22C:
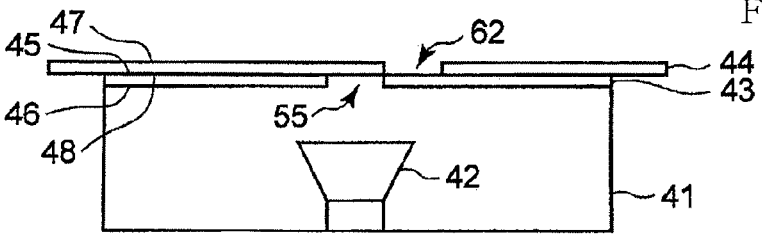
FIG. 22C is a sectional view of the speaker taken along the C-C' line of FIG. 22A.

FIG. 22A is a front view of a speaker 40 that constitutes a second embodiment of the acoustic structure of the present invention, FIG. 22B is a sectional view of the speaker 40 taken along the B-B' line of FIG. 22A, and FIG. 22C is a sectional view of the speaker 40 taken along the C-C' line of FIG. 22A. The speaker 40 is incorporated in a portable terminal, such as a portable telephone, to output a sound signal, generated by a control section of the terminal, as an audible sound. In the speaker 40, as shown in FIGS. 22A, 22B and 22C, a speaker unit 42 is provided within a box-shaped casing 41 opening at one end and fixed at its back to the box-shaped casing 41, and two layers of panels 43 and 44 are provided on the front end of the casing 41 to partition between the interior and exterior of the casing 41.

Figure 23A:
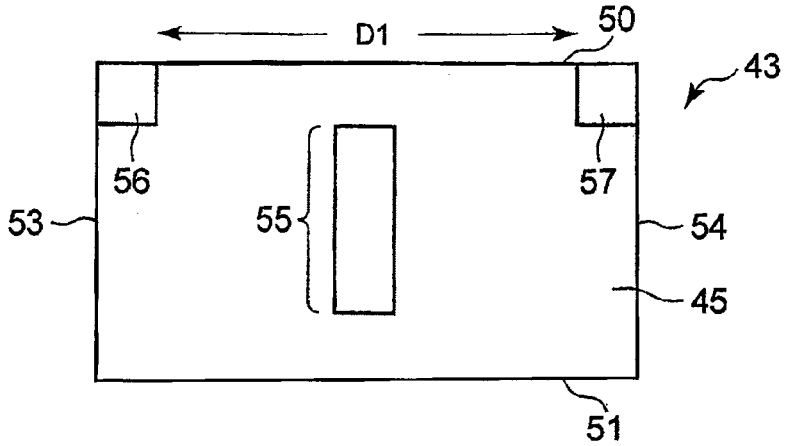
FIGS. 23A and 23B are front views showing panels of the speaker of FIGS. 22A to 22C.
Figure 23B:
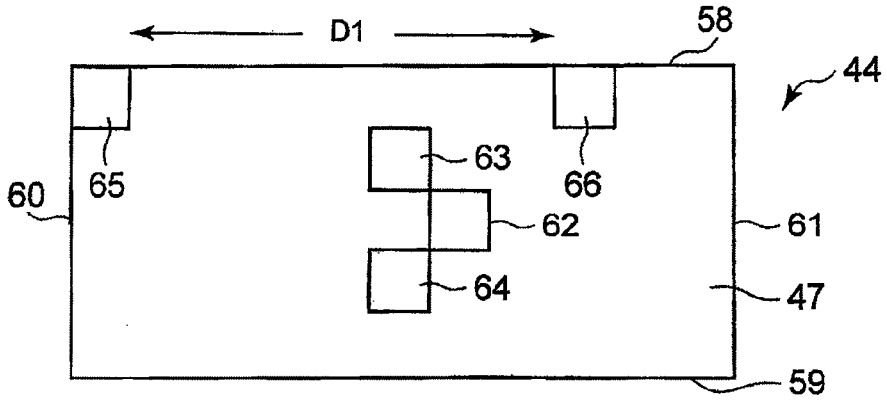

FIGS. 23A and 23B are front views of the panels 43 and 44. The panels 43 and 44 are identical to each other in width and thickness. The panel 44 is longer in length than the panel 43. Three openings 55, 56 and 57 are formed, through the thickness of the panel 43 (i.e., through the thickness between front and back surfaces 45 and 46 of the panel 43), in the middle of the front surface 45 of the panel 43 and in positions near inside of two corners of the front surface 45 where one of long sides 50 intersects with two short sides 53 and 54. Of the openings 55, 56 and 57, the openings 56 and 57 each have a square shape, while the opening 55 has a rectangular shape equal in size to an imaginary rectangle formed by three openings 56 being linearly arranged end to end in the width direction of the panel 43. The openings 56 and 57 are separated or spaced apart from each other by a distance D1.

Further, three openings 62, 63 and 64 are formed, through the thickness of the panel 44 (i.e., through the thickness between front and back surfaces 47 and 48 of the panel 44), in each of positions displaced from the center of the front surface 47, by a distance equal to the width of the above-mentioned opening 56, toward one short side 61, one long side 58 and the other long side 59. Two other openings 65 and 66 are formed, through the thickness of the panel 44 (i.e., between the front and back surfaces 47 and 48 of the panel 44), in a position near inside of a corner of the front surface 47 where the one long side 58 intersects with the other short side 60 and in a position located the distance D1 from the corner toward the short side 61. These five openings 62 to 66 each have a square shape of the same size as the opening 56.

As shown in FIGS. 22B and 22C, the back surface 46 of the panel 43 is fixed to the casing 41 to close an open surface of the casing 41. Further, guide members 67 and 68 are provided on opposite sides of the panel 43; namely, opposite side edge portions of the panel 44 are fitted in inner side portions of the guide members 67 and 68. The guide members 67 and 68 not only support the panel 44 on the surface 45 of the panel 43, but also function as a slide means for sliding the panel 44 along the surface 45 of the other panel 43.

In the speaker 40, a Helmholtz resonator is formed by overlapping portions OV between the openings 55 to 57 of the panel 43 and the openings 62 to 66 of the panel 44 (overlapping portions between the opening 55 and the openings 63 and 64 in the illustrated examples of FIGS. 22A, 22B and 22C) and a space 69 within the casing 41 excluding the speaker unit 42. Further, in the speaker 40, the overlapping portions OV and the space 69 function as the neck and cavity, respectively, of the Helmholtz resonator. Thus, as the Helmholtz resonator generates a sound of the resonant frequency f of Helmholtz resonance, the sound can be enhanced.

Figure 24A:
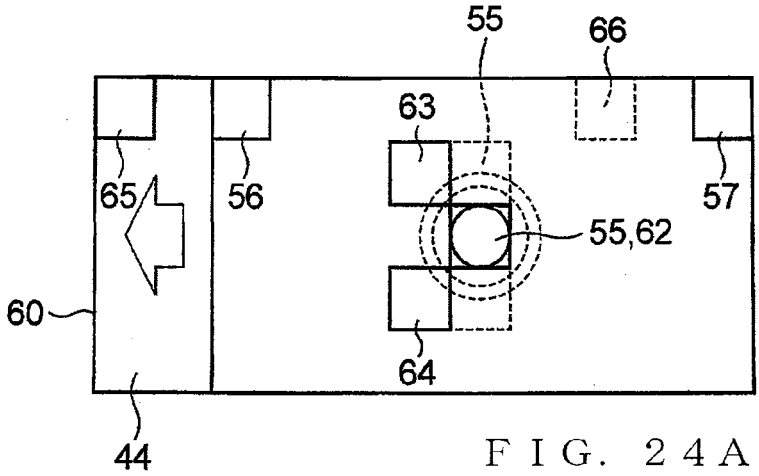
FIGS. 24A and 24B are views showing how positional relationship between a neck and a cavity of the speaker varies.
Figure 24B:
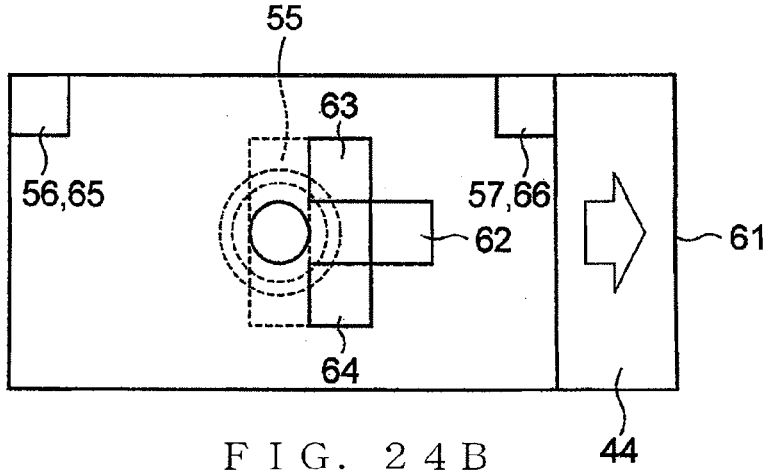

The speaker 40 is constructed in such a manner as to permit variation in relative positional relationship between the overlapping portions OV functioning as the neck and the space functioning as the cavity. More specifically, as the panel 44 is slid toward the short side 60 by a distance equal to one of the openings, as shown in FIG. 24A, the opening portions OV between the opening 55 and the openings 63 and 64 disappear, but there appears an overlapping portion between the opening 55 and the opening 62. Further, as the panel 44 is slid toward the short side 61 by a distance equal to one of the openings, as shown in FIG. 24B, the opening portions OV between the opening 55 and the openings 63 and 64 disappear, but the opening portions OV between the openings 56 and 57 and the openings 65 and 66 appear. Namely, in this speaker 40, as the panel 44 is slid, the above-mentioned minimum distance $D_{MIN}$ varies. Thus, the second embodiment can readily adjust the resonant frequency f by sliding movement of the panel 44.

Third Embodiment

Figure 25A:
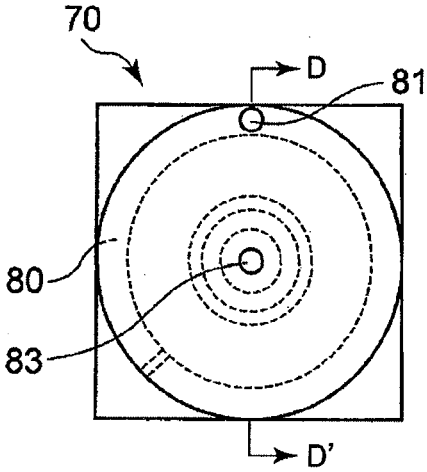
FIG. 25A is a front view of a speaker that constitutes a third embodiment of the acoustic structure of the present invention.
Figure 25B:
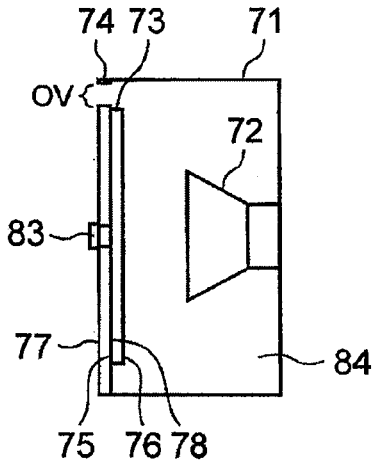
FIG. 25B is a sectional view of the speaker taken along the D-D' line of FIG. 25A.

FIG. 25A is a front view of a speaker 70 that constitutes a third embodiment of the acoustic structure of the present invention, and FIG. 25B is a sectional view of the speaker 70 taken along the D-D' line of FIG. 25A. In the speaker 70, a speaker unit 72 is provided within a box-shaped casing 71 opening at one end and fixed at its back to the box-shaped casing 71, and two layers of panels 73 and 74 are provided on the front end of the casing 71 to partition between the interior and exterior of the casing 71.

Figure 26A:
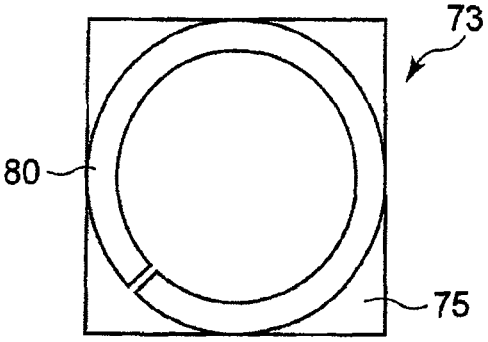
FIGS. 26A and 26B are front views showing panels of the speaker of FIGS. 25A and 25B.
Figure 26B:
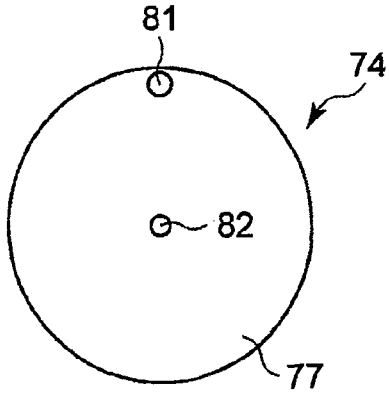

FIGS. 26A and 26B are front views of the panels 73 and 74. Front and back surfaces 75 and 76 of the panel 73 have a square shape. Front and back surfaces 77 and 78 of the panel 74 have a perfect circle shape. Each of sides of the front and back surfaces 75 and 76 of the panel 73 has a length equal to the diameter of the front and back surfaces 77 and 78 of the panel 74. The panel 73 has an annular opening 80 formed through the thickness of the panel 73 (i.e., thickness between the front and back surfaces 75 and 76 of the panel 73). An opening 81 of a perfect circle shape is formed, through the thickness of the panel 74 (i.e., thickness between the front and back surfaces 77 and 78 of the panel 74), near inside of the outer periphery of the panel 74. The opening 81 has a diameter slightly smaller than a width of the opening 80. The outer periphery of the opening 80 of the panel 73 is in contact with the four sides of the front and back surfaces 75 and 76 of the panel 73.

As shown in FIGS. 25A and 25B, the back surface 76 of the panel 73 is fixed to the casing 71 to close an open surface of the casing 71. Further, as shown in FIG. 26B, the panel 74 has a hole 82 formed centrally therein so that a shaft 83 is inserted through the hole 82. The shaft 83 functions as a rotation shaft for rotatably supporting the panel 74 on the panel 73.

Figure 27A:
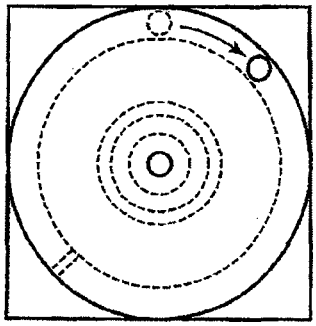
FIGS. 27A and 27B are views showing how positional relationship between a neck and a cavity of the speaker varies.
Figure 27B:
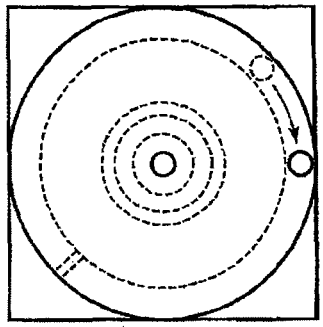

In the speaker 70, like in the above-described speaker (second embodiment) 40, a Helmholtz resonator is formed by an overlapping portion OV between the openings 80 and 81 and a space 84 within the casing 71 excluding the speaker unit 72. The speaker 70 is constructed in such a manner as to permit variation in relative positional relationship between the overlapping portion OV functioning as the neck and the space 84 functioning as the cavity of the Helmholtz resonator. More specifically, as the panel 74 is rotated clockwise through 45 degrees, the opening portion OV constituting the neck moves away from an inner surface portion of the casing 71, as shown in FIG. 27A. Then, as the panel 74 is further rotated clockwise through 45 degrees, the opening portion OV constituting the neck approaches another inner surface portion of the casing 71, as shown in FIG. 27B. Namely, in this speaker 70, as the panel 74 is rotated, the above-mentioned minimum distance $D_{MIN}$ varies. Thus, the third embodiment can readily adjust the resonant frequency f by rotating movement of the panel 74.

Fourth Embodiment

Figure 28A:
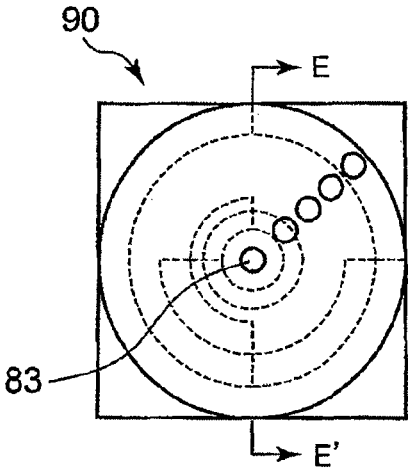
FIG. 28A is a front view of a speaker that constitutes a fourth embodiment of the acoustic structure of the present invention.
Figure 28B:
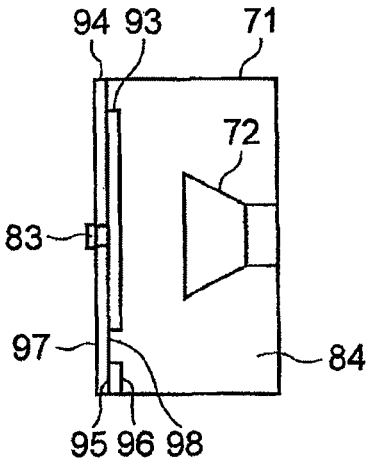
FIG. 28B is a sectional view of the speaker taken along the E-E' line of FIG. 28A.

FIG. 28A is a front view of a speaker 90 that constitutes a fourth embodiment of the acoustic structure of the present invention, and FIG. 28B is a sectional view of the speaker 90 taken along the E-E' line of FIG. 28A. The speaker 90 is characterized by including panels 93 and 94 in place of the panels 43 and 44 of the above-described speaker (third embodiment) 70. In FIGS. 28A and 28B, similar elements to those in FIGS. 25A and 25B are indicated by the same reference numerals and characters as used in FIGS. 25A and 25B and will not be described here to avoid unnecessary duplication.

Figure 29A:
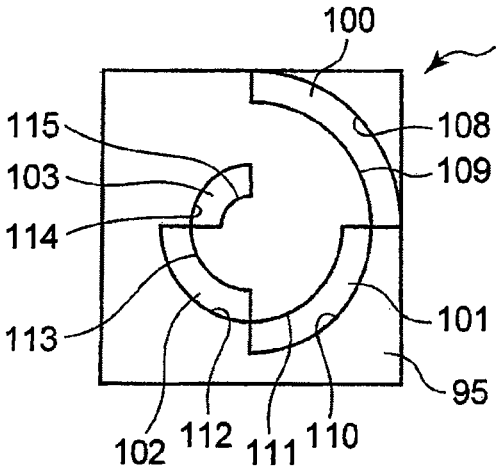
FIGS. 29A and 29B are front views of panels of the speaker of FIGS. 28A and 28B.
Figure 29B:
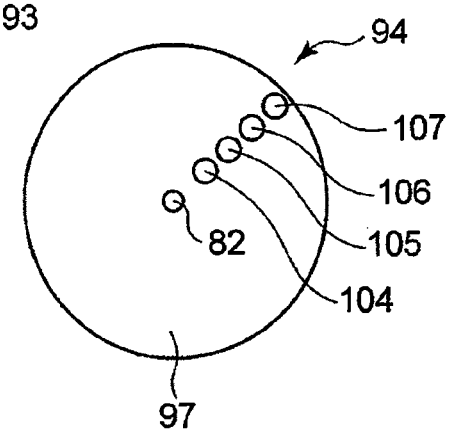

FIGS. 29A and 29B are front views of the panels 93 and 94. The panel 93 has four openings 100, 101, 102 and 103 formed through the thickness of the panel 93 (i.e., thickness between front and back surface 95 and 96 of the panel 93). The panel 94 has four openings 100, 101, 102 and 103 formed through the thickness of the panel 94 (i.e., thickness between front and back surface 97 and 98 of the panel 94). The openings 100 to 103 of the panel 93 each have a quarter-circle arcuate shape, while the openings 104 to 107 each have a perfect-circle shape. Each of the openings 104 to 107 has a diameter slightly smaller than a width of each of the openings 100 to 103. Large-small relationship in size among the four openings 100 to 103 of the panel 93 is opening 100>opening 101>opening 102>opening 103.

The four openings 100 to 103 of the panel 93 are positioned in the following layout. First, the opening 100 has an outer periphery 108 contacting two adjoining sides of the front and back surfaces 95 and 96 sandwiching therebetween one of four corners of the panel 93. The opening 101 has an outer periphery 111 that corresponds to an inner periphery 109 of the opening 100 imaginarily angularly moved clockwise through ninety degrees about the center of the panel 93. Further, the opening 102 has an outer periphery 112 that corresponds to an inner periphery 111 of the opening 101 imaginarily angularly moved clockwise through ninety degrees about the center of the panel 93, and the opening 103 has an outer periphery 114 that corresponds to an inner periphery 113 of the opening 102 imaginarily angularly moved clockwise through ninety degrees about the center of the panel 93. Furthermore, the openings 104 to 107 of the panel 94 are arranged, linearly at equal intervals, from the center of the panel 94 toward the outer periphery of the panel 104. In this speaker 90 too, as the panel 94 is rotated, the above-mentioned minimum distance $D_{MIN}$ varies. Thus, the fourth embodiment can readily adjust the resonant frequency f by rotating movement of the panel 94.

Fifth Embodiment

Figure 30A:
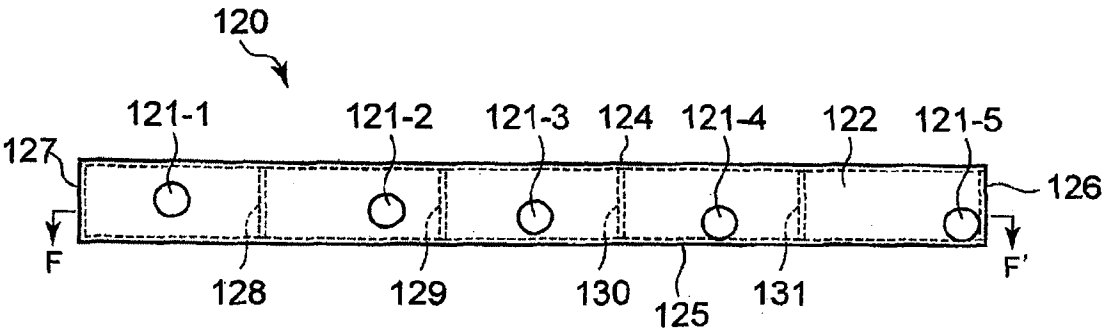
FIG. 30A is a front view of a sound absorbing panel that constitutes a fifth embodiment of the acoustic structure of the present invention.
Figure 30B:
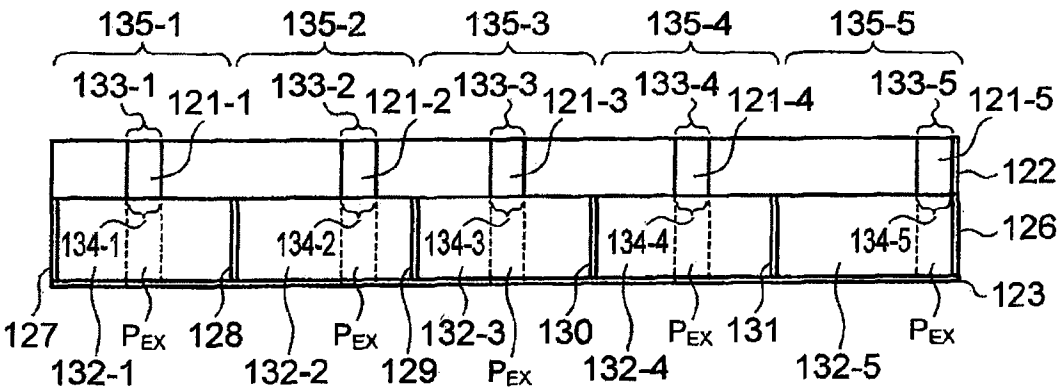
FIG. 30B is a sectional view of the sound absorbing panel taken along the F-F' line of FIG. 30A.

FIG. 30A is a front view of a sound absorbing panel 120 that constitutes a fifth embodiment of the acoustic structure of the present invention, and FIG. 30B is a sectional view of the sound absorbing panel 120 taken along the F-F' line of FIG. 30A. The sound absorbing panel 120 includes: a large-thickness plate 122 having holes 121-*i* (i=1-5) formed therein; a small-thickness plate 123 smaller in thickness than the large-thickness plate 122; side surface plates 124, 125, 126 and 127 disposed between respective ends of the large-thickness plate 122 and small-thickness plate 123; and partition plates 128, 129, 130 and 131 disposed at equal intervals between the side surface plates 126 and 127 opposed to each other in an extending direction of the plates 122 and 123. With the partition plates 128-131, an airspace surrounded by the above-mentioned plates 122-127 is partitioned into spaces 132-*i* (i=1-5) each having a same volume V. The holes 121-*i* in the large-thickness plate 122 have respective open surfaces 133-*i* each having a perfect cycle shape and having a same area S. The holes 121-*i* are in communication with corresponding ones of the spaces 132-*i*. Lengths L from boundary surfaces 134-*i* between the holes 121-*i* and the corresponding spaces 132-*i* to the corresponding open surfaces 133-*i* are set at a same value.

In the sound absorbing panel 120, the holes 121-*i* (i=1-5) and the spaces 132-*i* (i=1-5) constitute first to fifth Helmholtz resonators 135-*i* (i=1-5). The holes 121-*i* (i=1-5) and the spaces 132-*i* (i=1-5) function as necks and cavities, respectively, of the Helmholtz resonators 135-*i* (i=1-5). Thus, once a sound of a resonant frequency f of any one of the Helmholtz resonators 135-*i* (i=1-5) enters the holes 121-*i* (i=1-5), acoustic energy of the sound is converted into air vibrating energy within the hole 121-*i* of each of the Helmholtz resonators so that the sound of the resonant frequency f is absorbed in each of the Helmholtz resonators.

In the sound absorbing panel 120, relative positional relationship between the hole 121-*i* functioning as the neck and the space 132-*i* functioning as the cavity differs among the Helmholtz resonators 135-*i*. More specifically, in the Helmholtz resonators 135-1, 135-2 and 135-3, the virtual extension surface $P_{EX}$ provided by an inner region of the hole 121-*i* being extended into the space 132-*i* is spaced from the intersecting surface $P_{CR}$ (plates 124-130 in the illustrated example of FIG. 30A) (i.e., minimum distance $D_{MIN}>0$). Large-small relationship, among the Helmholtz resonators 135-1, 135-2 and 135-3, in minimum distance $D_{MIN}$ between the virtual extension surface $P_{EX}$ and the intersecting surface $P_{CR}$ is Helmholtz resonator 135-1>Helmholtz resonator 135-2>Helmholtz resonator 135-3.

By contrast, in the Helmholtz resonators 135-4 and 135-5, the virtual extension surface $P_{EX}$ is in contact with the intersecting surface $P_{CR}$ (plates 125 and 126 in the illustrated example of FIG. 30A) (i.e., minimum distance $D_{MIN}=0$). An area of contact AR between the extension surface $P_{EX}$ and the intersecting surface $P_{CR}$ (plates 125 and 126) in the Helmholtz resonator 135-5 is greater than an area of contact AR between the extension surface $P_{EX}$ and the intersecting surface $P_{CR}$ (only plate 125) in the Helmholtz resonator 135-4. Thus, in the sound absorbing panel 120, the Helmholtz resonators 135-*i* (i=1-5) resonate at their respective resonant frequencies $f_1$, $f_2$, $f_3$, $f_4$ and $f_5$ ($f_1>f_2>f_3>f_4>f_5$). In this way, the sound absorbing panel 120 can absorb sounds of wide frequency bands. Further, because the necks and cavities constituting the Helmholtz resonators 135-*i* (i=1-5) are uniform in shape and size among the Helmholtz resonators 135-*i*, the sound absorbing panel 120 as a whole can impart a feeling of design unity to persons viewing the sound absorbing panel 120. Note that at least two of the Helmholtz resonators may differ from each other in relative positional relationship between the neck and the cavity.

Sixth Embodiment

Figure 31A:
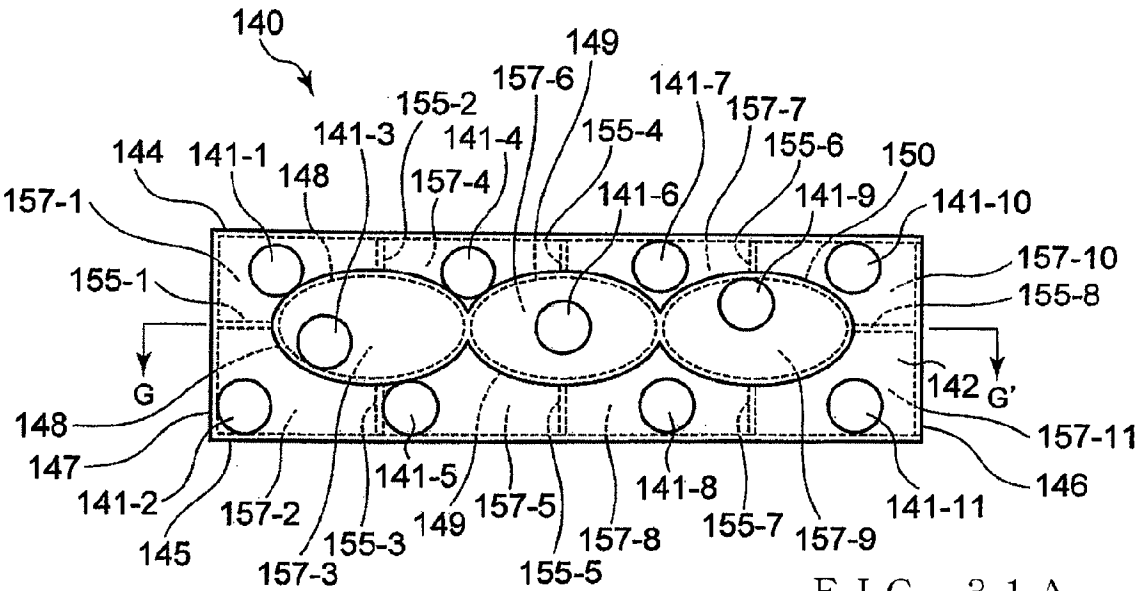
FIG. 31A is a front view of a sound absorbing panel that constitutes a sixth embodiment of the acoustic structure of the present invention.
Figure 31B:
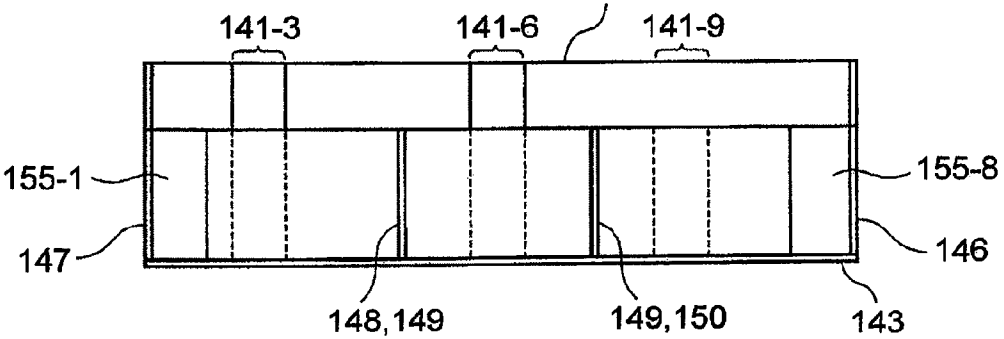
FIG. 31B is a sectional view of the sound absorbing panel taken along the G-G' line of FIG. 31A.

FIG. 31A is a front view of a sound absorbing panel 140 that constitutes a sixth embodiment of the acoustic structure of the present invention, and FIG. 31B is a sectional view of the sound absorbing panel 140 taken along the G-G' line of FIG. 31A. The sound absorbing panel 140 includes: a large-thickness plate 142 having holes 141-*k* (i=1-11) formed therein; a small-thickness plate 143 smaller in thickness than the large-thickness plate 142; and side surface plates 144, 145, 146 and 147 disposed between respective ends of the large-thickness plate 142 and small-thickness plate 143. An airspace surrounded by the above-mentioned plates 142-147 is partitioned, by three cylindrical plates 148, 149 and 150 and eight partition plates 155-*j*=1-8), into spaces 157-*k* (k=1-11) each having a same volume V, and each of the spaces 157-*k* is in communication with the outside via a corresponding one of the holes 141-*k*=1-11).

More specifically, as shown in FIG. 31A, the cylindrical plates 148, 149 and 150 are arranged on an imaginary straight line passing centrally through between the side surface plates 144 and 145. The cylindrical plate 148 has an outer peripheral surface contacting an outer peripheral surface of the cylindrical plate 149, and the outer peripheral surface of the cylindrical plate 149 contacts an outer peripheral surface of the cylindrical plate 150. The partition plate 155-1 is disposed between the outer peripheral surface of the cylindrical plate 148 and the side surface plate 147, and the partition plates 155-2 and 155-3 are disposed between the outer peripheral surface of the cylindrical plate 148 and the side surface plates 144 and 145. The partition plates 155-4 and 155-5 are disposed between the outer peripheral surface of the cylindrical plate 149 and the side surface plates 144 and 145. Further, the partition plates 155-6 and 155-7 are disposed between the outer peripheral surface of the cylindrical plate 150 and the side surface plates 144 and 145, and the partition plate 155-8 is disposed between the outer peripheral surface of the cylindrical plate 150 and the side surface plate 146. Thus, this sound absorbing panel 140 too can absorb sounds of wide frequency bands.

Seventh Embodiment

Figure 32:
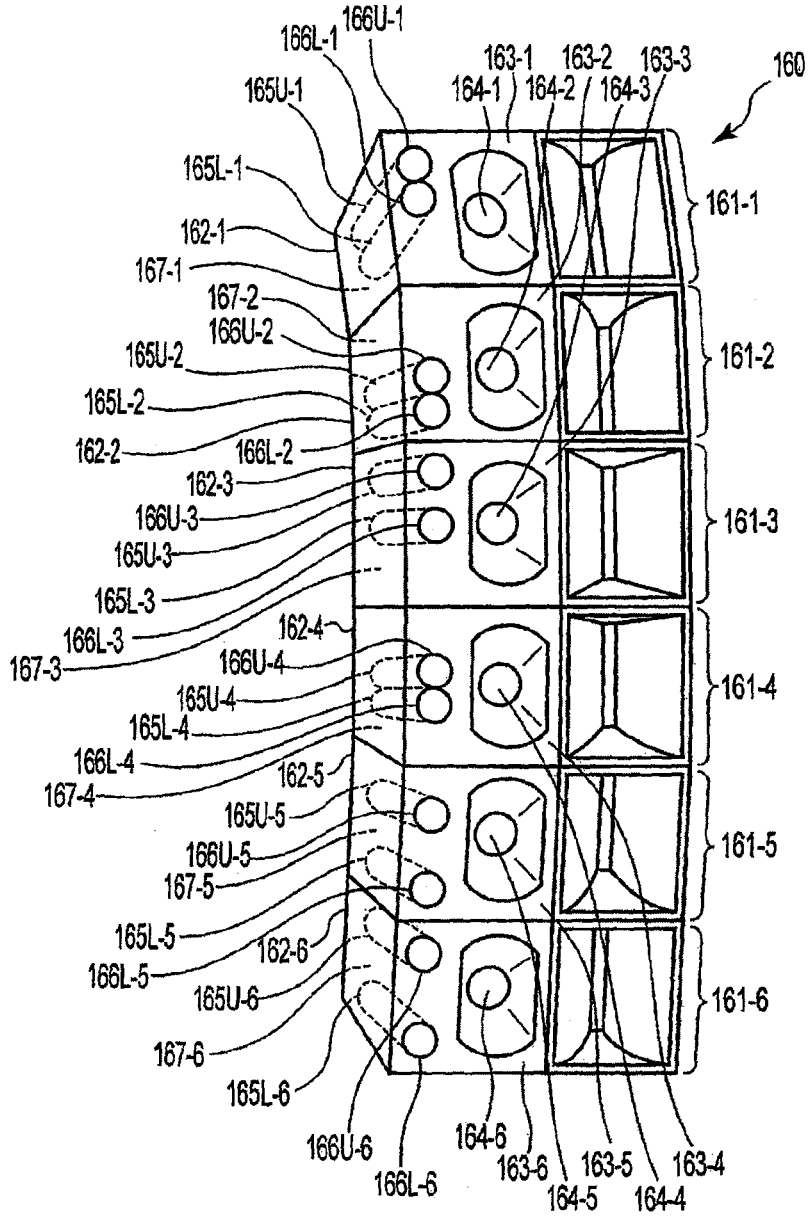
FIG. 32 is a perspective view of a line array speaker that constitutes a seventh embodiment of the acoustic structure of the present invention.

FIG. 32 is a perspective view of a line array speaker 160 that constitutes a seventh embodiment of the acoustic structure of the present invention. This line array speaker 160 comprises six bass reflex type speakers 161-*m* (m=1-6) interconnected in an up-down or vertical direction. Each of the bass reflex type speakers 161-*m* includes a speaker unit 164-*m* provided on a front surface 163-*m* of a box-shaped speaker enclosure 162-*m*, and two bass reflex ports 165U-m and 165L-m projecting from the front surface 163-*m* into the speaker enclosure 162-*m*.

The bass reflex ports 165U-m and 165L-m each have a cylindrical shape, and circular open surfaces 166U-m and 166L-m located at respective one ends of the ports 165U-m and 165L-m are exposed out of the front surface 163-*m*. Areas S of the open surfaces 166U-m and 166L-m, lengths L of the bass reflex ports 165U-m and 165L-m and volumes V of spaces 167-*m* within the speaker enclosures 162-*m* excluding the speaker units 164-*m* and bass reflex ports 165U-m and 165L-m are set at the same values, for all of the bass reflex type speakers 161-*m* (m=1-6). Namely, the bass reflex type speakers 161-*m* (m=1-6) have the same area S of the open surface, same length L of the bass reflex port and same volume V of the space.

Each of the bass reflex type speakers 161-*m* in the line array speaker 160 provides a Helmholtz resonator in conjunction with the bass reflex ports 165U-m and 165L-m and space 167-*m*. The bass reflex ports 165U-m and 165L-m and space 167-*m* function as the necks and cavity, respectively, of the Helmholtz resonator. Relative positional relationship between the bass reflex ports 165U-m and 165L-m and the space 167-*m* differs among the bass reflex type speakers 161-*m*. More specifically, in the line array speaker 160, an interval between the bass reflex ports 165U-m and 165L-m and an interval between each of the two open surfaces 166U-m and 166L-m and the inner wall surface of the space 167-*m* differ among the bass reflex type speakers 161-*m*. Thus, the seventh embodiment can enhance sound of various frequency bands from high to low frequency bands.

Eighth Embodiment

Figure 33A:
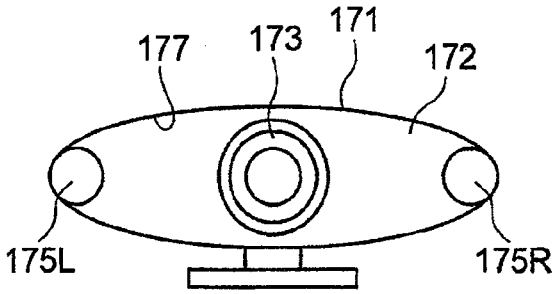
FIGS. 33A and 33B are a front view and a side view, respectively, of a bass reflex type speaker that constitutes an eighth embodiment of the acoustic structure of the present invention.
Figure 33B:
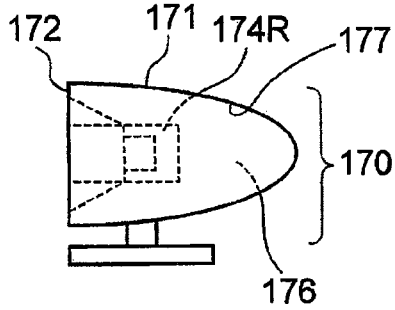

FIGS. 33A and 33B are a front view and a side view, respectively, of a bass reflex type speaker 170 that constitutes an eighth embodiment of the acoustic structure of the present invention. As shown in FIGS. 33A and 33B, the bass reflex type speaker 170 includes: a speaker enclosure 171 of a half-egg shape; a speaker unit 173 provided centrally on an elliptical front surface 172 of the speaker enclosure 171; and two bass reflex ports 174L and 174R projecting from the front surface 172 into the speaker enclosure 171.

The bass reflex ports 174L and 174R each have a cylindrical shape, and open surfaces 175L and 175R located at respective one ends of the bass reflex ports 174L and 174R are exposed out of the front surface 172. In this bass reflex type speaker 170, the bass reflex ports 174L and 174R and a space 176 within the speaker enclosure 171 excluding the speaker unit 173 and bass reflex ports 174L and 174R together constitute a Helmholtz resonator. The bass reflex ports 174L and 174R and the space 176 function as the necks and cavity, respectively, of the Helmholtz resonator.

In the bass reflex type speaker 170, the two bass reflex ports 174L and 174R are disposed separately at spaced-apart positions where they contact with a side surface 177 that is a surface intersecting with the front surface 172 of the speaker enclosure 171. More specifically, in the speaker enclosure 171, the open surfaces 175L and 175R of the bass reflex ports 174L and 174R are located at opposite ends, in a longitudinal axis direction, of the elliptical front surface 172 as viewed from the center of the front surface 172, and the open surfaces 175L and 175R are in contact with opposite end portions, in the longitudinal axis direction, of the inner peripheral surface of the front surface 172. The bass reflex ports 174L and 174R extend from the open surfaces 175L and 175R along the side surface 177. Further, in the bass reflex type speaker 170, surfaces formed by inner regions of the bass reflex ports 174L and 174R being extended into the space 176 define the virtual extension surface $P_{EX}$ while the side surface 177 of the enclosure 171 defines the intersecting surface $P_{CR}$, in which case the minimum distance $D_{MIN}$ between the virtual extension surface $P_{EX}$ and the intersecting surface $P_{CR}$ is 0 (zero). Thus, the instant embodiment can provide the bass reflex type speaker 170 which is capable of more effectively enhancing sounds of lower frequencies, by making slight design changes to a conventionally-known bass reflex type speaker of the same type where the bass reflex port is located closer to the center of the front surface of the speaker enclosure.

Ninth Embodiment

Figure 34A:
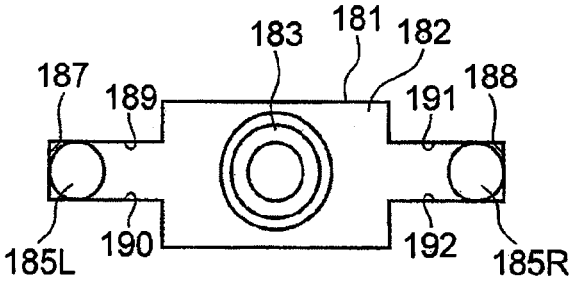
FIGS. 34A and 34B are a front view and a side view, respectively, of a bass reflex type speaker that constitutes a ninth embodiment of the acoustic structure of the present invention.
Figure 34B:
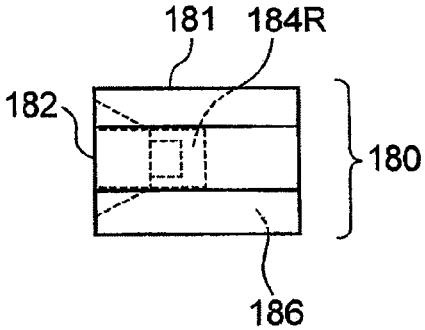

FIGS. 34A and 34B are a front view and a side view, respectively, of a bass reflex type speaker 180 that constitutes a ninth embodiment of the acoustic structure of the present invention. As shown in FIGS. 34A and 34B, the bass reflex type speaker 180 includes: a speaker enclosure 181 of a dodecagon cylindrical shape; a speaker unit 183 provided centrally on a dodecagonal front surface 182 of the speaker enclosure 181; and two bass reflex ports 184L and 184R projecting from the front surface 182 into the speaker enclosure 181.

The bass reflex ports 184L and 184R each have a cylindrical shape, and circular open surfaces 185L and 185R located at respective one ends of the bass reflex ports 184L and 184R are exposed out of the front surface 182. In this bass reflex type speaker 180, the bass reflex ports 184L and 184R and a space 186 within the speaker enclosure 181 excluding the speaker unit 183 and bass reflex ports 184L and 184R together constitute a Helmholtz resonator. The bass reflex ports 184L and 184R and the space 186 function as the necks and cavity, respectively, of the Helmholtz resonator.

In the bass reflex type speaker 180, the two bass reflex ports 184L and 184R are disposed separately at two spaced-apart positions where they contact with a side surface of the speaker enclosure 181 that is a surface intersecting with the front surface 172. More specifically, in the speaker enclosure 181, the open surface 185L of the bass reflex port 184L is in contact with three surfaces: a left side surface 187 of two side surfaces 187 and 188 opposed to each other in a left-right direction with the speaker unit 183 disposed or sandwiched centrally therebetween; and side surfaces 189 and 190 adjoining the opposite ends of the left side surface 187. On the other hand, the open surface 185R of the bass reflex port 184R is in contact with three surfaces: the right side surface 188; and side surfaces 191 and 192 adjoining the opposite ends of the right side surface 188. Further, the bass reflex port 184L extends from the open surface 185L along the side surfaces 187, 189 and 190, and the bass reflex port 184R extends from the open surface 185R along the side surfaces 188, 191 and 192. Thus, in the bass reflex type speaker 180, surfaces formed by inner regions of the bass reflex ports 184L and 184R being extended into the space 186 define the virtual extension surface $P_{EX}$ while the side surfaces 187 to 192 of the enclosure 181 define the intersecting surface $P_{CR}$, in which case the minimum distance $D_{MIN}$ between the virtual extension surface $P_{EX}$ and the intersecting surface $P_{CR}$ is 0 (zero). Thus, the instant embodiment can provide the bass reflex type speaker 180 which is capable of more effectively enhancing sounds of lower frequencies, by making slight design changes to a conventionally-known bass reflex type speaker of the same type where the bass reflex port is located closer to the center of the front surface of the speaker enclosure.

Tenth Embodiment

Figure 35:
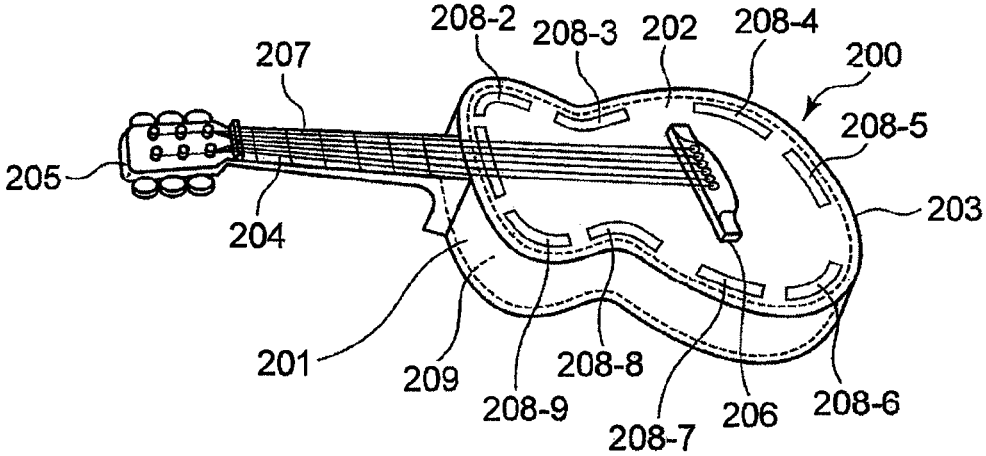
FIG. 35 is a perspective view of a guitar that constitutes a tenth embodiment of the acoustic structure of the present invention.

FIG. 35 is a perspective view of a guitar 200 that constitutes a tenth embodiment of the acoustic structure of the present invention. The guitar 200 includes: a body 203 comprising a front surface plate 202 and back surface plate (not shown) attached to a peripheral surface plate 201; and strings 207 stretched taut between a neck 205 provided at the distal end of a neck section 204 and a bridge 206 provided on the front surface plate 202 of the body 203. Nine sound holes 208-1 to 208-9 are formed in the front surface plate 202 near the peripheral surface plate 201, and these sound holes 208-1 to 208-9 are in communication with a space 209 within the body 203. In this guitar 200, the sound holes 208-1 to 208-9 and the space 209 together constitute a Helmholtz resonator. The sound holes 208-1 to 208-9 and the space 209 function as the necks and cavity, respectively, of the Helmholtz resonator. Thus, as a sound of the resonant frequency f of Helmholtz resonance is audibly generated by plucking of any one of the strings 207, the sound of the resonant frequency f is irradiated through the sound holes 208-1 to 208-9, so that the sound of the resonant frequency f can be effectively enhanced.

Further, in the guitar 200, the nine sound holes 208-1 to 208-9 are located separately at spaced-apart positions of the front surface plate 202 of the body 203 near the peripheral surface plate 201 intersecting with the front surface plate 202. More specifically, each of the sound holes 208-1 to 208-9 is located slightly inwardly of a portion of the front surface plate 202 fixedly attached to the peripheral surface plate 201, and each of the sound holes 208-1 to 208-9 has an elongated, substantially rectangular shape curved in conformity to the contour of the peripheral surface plate 201 located outwardly of the sound holes 208-1 to 208-9. In the guitar 200, surfaces formed by inner regions of the sound holes 208-1 to 208-9 being extended into the body 203 define the virtual extension surface $P_{EX}$ while the inner peripheral wall of the body 203 define the intersecting surface $P_{CR}$, in which case the minimum distance $D_{MIN}$ between the virtual extension surface $P_{EX}$ and the intersecting surface $P_{CR}$ is of a value slightly greater than 0 (zero). Thus, the instant embodiment can provide the guitar 200 which is capable of more effectively enhancing sounds of lower frequencies, using the body and neck section, connected to the body, of a conventionally-known guitar of the same type where a sound hole is located centrally in the front surface plate of the body.

Other Embodiments

Whereas the foregoing have described in detail the first to tenth embodiments of the present invention, various other embodiments of the invention are also possible as exemplified below.

(1) The first to tenth embodiments of the present invention have been described above as provided by applying the basic principles of the present invention to a bass reflex type speaker, a small-size speaker mounted on or in a portable terminal, a sound absorbing panel, a line array speaker and a guitar. However, the basic principles of the invention may be applied to any other acoustic structures than the aforementioned.

(2) In the above-described first to tenth embodiments, the intersecting surface $P_{CR}$ need not necessarily be a surface intersecting perpendicularly with a surface to which the neck is connected (i.e., surface which has the neck connected thereto). Of the individual surfaces defining the cavity, one surface intersecting at an acute angle with the surface which has the neck connected thereto is connected may be made the intersecting surface $P_{CR}$, or another surface intersecting at an obtuse angle with the surface which has the neck connected thereto is connected may be made the intersecting surface $P_{CR}$.

(3) In the above-described third and fourth embodiments, the panels 74 and 94 are supported via the shaft 82 in such a manner that they are rotatable about the shaft 82 relative to the panels 73 and 93, respectively. Alternatively, the panels 73 and 93 may be made rotatable relative to the panels 74 and 94, respectively. Further, in the third embodiment, both of the panels 73 and 74 may be rotatably supported via the shaft 83. In the fourth embodiment too, both of the panels 93 and 94 may be rotatably supported via the shaft 83.

(4) In the above-described fifth embodiment, the basic principles of the present invention may be applied to a sound absorbing panel comprising two to fourth Helmholtz resonators, or may be applied to a sound absorbing panel comprising six or more Helmholtz resonators.

(5) In the above-described eighth and ninth embodiments, the bass reflex ports 174 and 184 may be replaced with only one or three or more bass reflex ports.

(6) In the above-described tenth embodiment, the number of the sound holes 208 may be selected from a range of one to eight, or may be ten or more. Further, the sound holes may be formed in any other desired shapes than the elongated, substantially rectangular shape (7) In the above-described eighth embodiment, the bass reflex ports 174 of the bass reflex type speaker 170 may be replaced with only one bass reflex port 174, to construct a bass reflex type speaker 170' where the one bass reflex port 174 is located slightly spaced from the side surface 177. In this case, a distance between the bass reflex port 174 and the side surface 177 may be set such that a ratio DMIN-Ratio between a minimum distance DMIN-170' between the surface formed by the inner region of the bass reflex port 174 being extended into the space 176 (i.e., virtual extension surface PEX) and the side surface 177 (i.e., intersecting surface PCR) and a minimum distance DMIN-Center of a bass reflex type speaker 170-Center having the bass reflex port 174 located at the center of the front surface 172 (i.e., Dram-Ratio=DMIN-170'/DMIN-Center) is 0.1 or less. With such a construction where the ratio Dram-Ratio is 0.1 or less, the additional acoustic mass ratio α-Ratio in the illustrated example of FIG. 21 can be 1.10 or over, so that the resonant frequency of the bass reflex type speaker 170' can be lowered to a sufficiently low frequency. Further, in the above-described ninth embodiment, the bass reflex ports 184 of the bass reflex type speaker 180 may be replaced with only one bass reflex port 184, to construct a bass reflex type speaker 180' where the one bass reflex port 184 is located slightly spaced from the side surface. In this case, a distance between the bass reflex port 184 and the side surface may be set such that a ratio DMIN-Ratio between a minimum distance DMIN-180' between the surface formed by the inner region of the bass reflex port 184 being extended into the space 186 (i.e., virtual extension surface PEX) and the side surface (i.e., intersecting surface PCR) and a minimum distance DMIN-Center of a bass reflex type speaker 180-Center having the bass reflex port 184 located at the center of the front surface 182 (i.e., DMIN-Ratio=DMIN-180'/DMIN-Center) is 0.1 or less.

(8) In the above-described speaker 40 that constitutes the second embodiment of the present invention, the interior and exterior of the casing 41, functioning as the cavity of the Helmholtz resonator, are partitioned from each other by the two layers of panels 43 and 44 each having an opening. Further, the above-described speaker 40 includes the guide members 67 and 68 as slide means for sliding the panel 44 along the other panel 43. However, the layers of panels partitioning between the interior and exterior of the casing 41 need not necessarily be just two layers of panels and may be three or more layers of panels. For example, the interior and exterior of the casing 41 may be partitioned from each other by three layers of panels 43', 43 and 44 each having an opening. In such a case, the neck of the Helmholtz resonator may be formed by an overlapping portion OV between the openings of the panels 43', 43 and 44. Further, in this case, the guide members 67 and 68 as the slide means may slidably support either all or some of the layers of panels. For example, the panels 43' and 43 of the panels 43', 43 and 44 may be layered on the edge of the open surface of the casing 41 with the openings of the panels 43' and 43 overlapped with each other, and only the uppermost panel 44 may be supported for sliding movement relative to the panel 43. In this modified embodiment, when the openings of the panels 44, 43 and 43' are placed in a mutually overlapped position through the sliding movement of the panel 44, the overlapping portion OV among the openings of the panels 44, 43 and 43' constitute the neck of the Helmholtz resonator.

(9) Further, in the speaker 70 that constitutes the third embodiment of the present invention, the interior and exterior of the casing 41, functioning as the cavity of the Helmholtz resonator, are partitioned from each other by the two layers of panels 73 and 74 each having an opening. Further, the above-described speaker 70 includes the shaft 83 as a rotation shaft rotatably supporting the panels 73 and 74. However, the layers of panels partitioning between the interior and exterior of the casing 71 need not necessarily be just two layers of panels and may be three or more layers of panels. For example, the interior and exterior of the casing 71 may be partitioned from each other by three layers of panels 73', 73 and 74 each having an opening. In such a case, the neck of the Helmholtz resonator may be formed by an overlapping portion OV among the openings of the panels 73', 73 and 74. Further, in this case, the shaft 83 as the rotation shaft may rotatably support either all or some of the layers of panels. For example, the panels 73' and 73 of the panels 73', 73 and 74 may be layered on the edge of the open surface of the casing 71 with the openings of the panels 73' and 73 overlapped with each other, and only the uppermost panel 74 may be supported for sliding movement relative to the panel 73. In this modified embodiment, when the openings of the panels 74, 73 and 73' are placed in a mutually overlapped position through the rotating movement of the panel 74, the overlapping portion OV among the openings of the panels 74, 73 and 73' constitute the neck of the Helmholtz resonator.

This application is based on, and claims priorities to, JP PA 2010-040964 filed on 25 Feb. 2010 and JP PA 2010-126630 filed on 2 Jun. 2010. The disclosure of the priority applications, in its entirety, including the drawings, claims, and the specification thereof, are incorporated herein by reference.

What is claimed is:

1. An acoustic structure provided with a Helmholtz resonator, said acoustic structure being constructed to permit variation in relative positional relationship between a neck of said Helmholtz resonator and a cavity of said Helmholtz resonator communicating with the neck, said acoustic structure including:

two or more layers of panels each having an opening, the two or more layers of panels partitioning between an interior and exterior of said cavity, said neck being formed by an overlapping portion between the openings of the two or more layers of panels; and a sliding member that slides at least one of the two or more layers of panels along other of the two or more layers of panels.

2. The acoustic structure as claimed in claim 1, which further includes:

a rotation shaft that rotatably supports at least one of the two or more layers of panels.

3. The acoustic structure as claimed in claim 1, wherein each of two layers of panels among said two or more layers of panels has a plurality of openings, and a plurality of the necks are formed by overlapping portions between the openings of the two layers of panels.

4. An acoustic structure provided with a plurality of Helmholtz resonators including a first Helmholtz resonator and a second Helmholtz resonator, said acoustic structure being constructed to permit variation in first relative positional relationship between a first neck of the first Helmholtz resonator and a first cavity of the first Helmholtz resonator communicating with the first neck, said acoustic structure being further constructed to permit variation in second relative positional relationship between a second neck of the second Helmholtz resonator and a second cavity of the second Helmholtz resonator communicating with the second neck, wherein said first and second relative positional relationship are different from each other.

5. The acoustic structure as claimed in claim 4, wherein each of the plurality of Helmholtz resonators has a plurality of necks communicating with a single cavity, and the plurality of necks are disposed separately in spaced apart relation to each other along an intersecting surface which intersects with one of individual surfaces of the cavity which has the neck connected thereto.

6. An acoustic structure provided with a Helmholtz resonator, said acoustic structure being constructed as a bass reflex speaker and constructed to permit variation in relative positional relationship between a neck of said Helmholtz resonator and a cavity of said Helmholtz resonator communicating with the neck.

7. An acoustic structure provided with a Helmholtz resonator, said acoustic structure being constructed as a guitar and constructed to permit variation in relative positional relationship between a neck of said Helmholtz resonator and a cavity of said Helmhotz resonator communicating with the neck, and wherein a body of the guitar has a plurality of sound holes each functioning as the neck of the Helmholtz resonator, and each of the sound holes is in communication with a space within the body.

8. An acoustic structure comprising:

a plurality of Helmholtz resonators, each having a neck and a cavity communicating with the neck, the plurality of Helmholtz resonators being different from each other in relative positional relationship between the neck and the cavity, wherein each of the Helmholtz resonators has a same area of an open surface of the neck, a same volume of the cavity communicating with the neck and a same length from a boundary surface between the cavity and the neck to the open surface of the neck.

9. The acoustic structure as claimed in claim 8, wherein a minimum distance between an extension surface defined by an inner region of the neck being extended into the cavity and an intersecting surface intersecting with one of individual surfaces of the cavity which has the neck connected thereto is differentiated between the Helmholtz resonators.

10. The acoustic structure as claimed in claim 8, wherein an area of contact between an extension surface defined by an inner region of the neck being extended into the cavity and an intersecting surface intersecting with one of individual surfaces of the cavity which has the neck connected thereto is differentiated between the Helmholtz resonators.

11. The acoustic structure as claimed in claim 8, which is constructed as a sound absorbing panel.

12. The acoustic structure as claimed in claim 8, which is constructed as an array sound speaker.

* * * * *